US010139743B2

(12) United States Patent
Kitabatake et al.

(10) Patent No.: US 10,139,743 B2
(45) Date of Patent: Nov. 27, 2018

(54) TONERS FOR DEVELOPING ELECTROSTATIC IMAGES AND PRODUCTION METHOD THEREOF

(71) Applicant: Samsung Electronics Co., Ltd., Suwon-si (KR)

(72) Inventors: Takuya Kitabatake, Yokohama (JP); Fusaki Fujibayashi, Yokohama (JP); Hiroko Endo, Yokohama (JP); Masahide Yamada, Yokohama (JP); Kensuke Kubo, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/408,887

(22) Filed: Jan. 18, 2017

(65) Prior Publication Data

US 2017/0205723 A1 Jul. 20, 2017

(30) Foreign Application Priority Data

Jan. 18, 2016 (JP) ..... 2016-006874

(51) Int. Cl.

| | |
|---|---|
| ***G03G 9/09*** | (2006.01) |
| ***G03G 9/087*** | (2006.01) |
| ***G03G 9/08*** | (2006.01) |

(52) U.S. Cl.

CPC ..... *G03G 9/0902* (2013.01); *G03G 9/0804* (2013.01); *G03G 9/0815* (2013.01); *G03G 9/0819* (2013.01); *G03G 9/08711* (2013.01); *G03G 9/08755* (2013.01); *G03G 9/0926* (2013.01)

(58) Field of Classification Search

CPC ..... G03G 9/0902; G03G 9/08711; G03G 9/08755; G03G 9/0815; G03G 9/0819; G03G 9/0926; G03G 9/0804

See application file for complete search history.

(56) References Cited

U.S. PATENT DOCUMENTS

| | | | | |
|---|---|---|---|---|
| 5,346,797 | A | 9/1994 | Kmiecik-Lawrynowicz et al. | |
| 9,360,784 | B2 | 6/2016 | Fujibayashi et al. | |
| 2010/0178604 | A1 | 7/2010 | Lee et al. | |
| 2010/0196813 | A1* | 8/2010 | Shin | G03G 9/0804 430/108.4 |
| 2012/0138874 | A1 | 6/2012 | Yuan et al. | |
| 2015/0192873 | A1* | 7/2015 | Fujibayashi | G03G 9/091 430/108.3 |
| 2016/0238958 | A1* | 8/2016 | Yamada | G03G 9/08755 |

FOREIGN PATENT DOCUMENTS

| | | | |
|---|---|---|---|
| JP | 63-282752 | A | 11/1988 |
| JP | 6-250439 | A | 9/1994 |
| JP | 2001-303045 | A | 10/2001 |
| JP | 4013415 | B2 | 9/2007 |
| JP | 2012-247649 | A | 12/2012 |
| JP | 5369861 | B2 | 9/2013 |
| JP | 2015-132646 | A | 7/2015 |
| KR | 10-2010-0084017 | A | 7/2010 |

OTHER PUBLICATIONS

Piao, Xianqing, et al. "Synthesis of nitridosilicate CaSr1—x Eu x Si5N8 (x=0-1) phosphor by calcium cyanamide reduction for white light-emitting diode applications." Journal of the Electrochemical Society 155.1 (2008): J17-J22.

Extended European Search Report dated May 26, 2017, of the corresponding European Patent Application No. 17151842.6 (7 pages in English).

* cited by examiner

*Primary Examiner* — Thorl Chea

(74) *Attorney, Agent, or Firm* — NSIP Law

(57) ABSTRACT

A toner for developing electrostatic images includes a binder, a colorant, iron, silicon, and sulfur. The colorant includes a phosphor and a non-fluorescent colorant. The phosphor includes either one or both of a nitride and an oxynitride each including an alkaline-earth metal, silicon, and an activator element. A volume average particle diameter of the phosphor is greater than or equal to about 50 nm and less than or equal to about 400 nm. An internal quantum efficiency of the phosphor at an excitation wavelength of 450 nm is greater than or equal to about 60%.

22 Claims, No Drawings

TONERS FOR DEVELOPING ELECTROSTATIC IMAGES AND PRODUCTION METHOD THEREOF

CROSS-REFERENCE TO RELATED APPLICATIONS

This application claims the benefit under 35 USC 119(a) of Japanese Patent Application No. 2016-006874 filed on Jan. 18, 2016, in the Japan Patent Office, the entire disclosure of which is incorporated herein by reference for all purposes.

BACKGROUND

1. Field

This application relates to toners for developing electrostatic images and production methods thereof.

2. Description of Related Art

Methods of visualizing image information via electrostatic images such as electrophotographic methods are currently used in various fields. In the electrophotographic methods, after uniformly charging a photoreceptor surface, electrostatic images are formed on the photoreceptor surface, and an electrostatic image is developed by a developer including a toner and is visualized as a toner image. This toner image is transferred and fused to a recording medium to form an image. The developer may be a two-component developer including a toner and a carrier, or a one-component developer consisting of a magnetic toner or a non-magnetic toner alone.

A toner may be prepared by a kneading and grinding method wherein a thermoplastic resin is melt-kneaded together with colorants such as a pigment, a charge control agent, and a release agent such as a wax, and is pulverized and sieved after being cooled. In the kneading and grinding method, a shape and a surface structure of a toner are irregular, and reliability deterioration such as image quality degradation due to charge deterioration of the developer, toner scattering, and developability deterioration occurs.

A method of producing the toner by an emulsion polymerization aggregation method capable of controlling the toner shape and the toner surface structure has been proposed. In this method, resin particulate dispersion prepared by emulsion polymerization and a colorant particle dispersion in which a colorant is dispersed in the solvent are mixed and an agglomeration product corresponding to a toner particle diameter is formed. The formed agglomeration product is heated to be fused and united, and a toner particle of a desired particle diameter is obtained. According to this method, a small particle diameter of the toner particle is not only facilitated, but also an improved particle size distribution may be obtained.

In a digital full color copy machine, a color image of an original copy is color-separated through blue, green, and red color filters, and then obtained latent images corresponding to the color image of the original copy are developed using yellow, magenta, and cyan developers respectively complementary to the blue, green, and red color separations of the color image of the original copy and a black developer. A colorant in each color developer may have an influence on image quality (particularly, a color tone and transparency) or color reproducibility.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a toner for developing electrostatic images includes a binder, a colorant, iron, silicon, and sulfur; an amount of the iron is greater than or equal to about $1.0\times10^3$ ppm and less than or equal to about $1.0\times10^4$ ppm; an amount of the silicon is greater than or equal to about $1.0\times10^3$ ppm and less than or equal to about $5.0\times10^4$ ppm; an amount of the sulfur is greater than or equal to about 500 ppm and less than or equal to about 3000 ppm; an amount of the colorant is greater than or equal to about 3.5 wt % and less than or equal to about 7 wt % based on a total weight of the toner; the colorant includes a phosphor and a non-fluorescent colorant; an amount of the phosphor is greater than or equal to about 0.25 wt % and less than or equal to about 4.55 wt % based on the total weight of the toner; the phosphor includes either one or both of a nitride and an oxynitride each including an alkaline-earth metal, silicon, and an activator element; a volume average particle diameter of the phosphor is greater than or equal to about 50 nm and less than or equal to about 400 nm; and an internal quantum efficiency of the phosphor at an excitation wavelength of 450 nm is greater than or equal to about 60%.

The phosphor may include an oxynitride having a general chemical formula represented by $MSi_2O_2N_2$; the oxynitride may have a same crystal structure as $SrSi_2O_2N_2$; the M may include the alkaline-earth metal and the activator element; the alkaline-earth metal may include Sr and optionally either one or both of Ca and Ba; the activator element may include Eu and optionally Ce; the amount of the Sr may be greater than or equal to about 15 mol % and less than or equal to about 99 mol % based on a total amount of the M; the amount of the activator element may be greater than or equal to about 1 mol % and less than or equal to about 20 mol % based on the total amount of the M; and the phosphor may have a light emitting peak wavelength in a range of greater than or equal to about 530 nm and less than or equal to about 570 nm.

The toner may include a coating layer consisting of the binder on its outer surface.

The coating layer may have a thickness of greater than or equal to about 0.2 μm and less than or equal to about 1.0 μm.

The toner may have a volume average particle diameter of greater than or equal to about 3 μm and less than or equal to about 9 μm.

A coefficient of variation of a particle diameter of the toner may be greater than or equal to about 15% and less than or equal to about 25%.

The toner may have a weight average molecular weight of greater than or equal to about 7000 and less than or equal to about 50000.

A ratio of a weight average molecular weight to a number average molecular weight of the toner may be greater than or equal to about 7.0 and less than or equal to about 17.0.

A glass transition temperature of the toner may be greater than or equal to about 50° C. and less than or equal to about 70° C.

An acid value of the toner may be greater than or equal to about 5 mg KOH/g and less than or equal to about 25 mg KOH/g.

The binder may include an amorphous polyester-based resin and a crystalline polyester resin.

The binder may include any one or any combination of any two or more of an amorphous styrene polymer, an amorphous acrylic polymer, and an amorphous styrene-acryl copolymer.

The non-fluorescent colorant may include either one or both of a dye and a pigment.

In another general aspect, a method of producing a toner for developing electrostatic images described above includes forming a latex of a binder; forming a first dispersion of the phosphor; forming a second dispersion of the non-fluorescent colorant; mixing the latex, the first dispersion, and the second dispersion to form a mixed solution; and adding an agglomerating agent to the mixed solution to form a primary agglomeration particle including the binder, the phosphor, and the non-fluorescent colorant.

The method may further include disposing a coating layer consisting of the binder on the surface of the primary agglomeration particle to form a coated agglomeration particle.

The binder may include an amorphous binder; and the method may further include heating a dispersion including the coated agglomeration particle at a higher temperature than a glass transition temperature of the amorphous binder to fuse particles in the coated agglomeration particle.

The first dispersion and the second dispersion may each include an anionic surfactant.

The agglomerating agent may include the iron and the silicon.

A volume average particle diameter of the primary agglomeration particle may be greater than or equal to about 2.5 μm and less than or equal to about 8.5 μm.

In another general aspect, a toner for developing electrostatic images includes a binder, a colorant, iron, silicon, and sulfur; the colorant includes a phosphor and a non-fluorescent colorant; the phosphor includes either one or both of a nitride and an oxynitride each including an alkaline-earth metal, silicon, and an activator element; a volume average particle diameter of the phosphor is greater than or equal to about 50 nm and less than or equal to about 400 nm; and an internal quantum efficiency of the phosphor at an excitation wavelength of 450 nm is greater than or equal to about 60%.

An amount of the iron may be greater than or equal to about $1.0\times10^3$ ppm and less than or equal to about $1.0\times10^4$ ppm; an amount of the silicon may be greater than or equal to about $1.0\times10^3$ ppm and less than or equal to about $5.0\times10^4$ ppm; and an amount of the sulfur may be greater than or equal to about 500 ppm and less than or equal to about 3000 ppm.

An amount of the colorant including the phosphor and the non-fluorescent colorant may be greater than or equal to about 3.5 wt % and less than or equal to about 7 wt % based on a total weight of the toner; and an amount of the phosphor may be greater than or equal to about 0.25 wt % and less than or equal to about 4.55 wt % based on the total weight of the toner.

Other features and aspects will be apparent from the following detailed description and the claims.

DETAILED DESCRIPTION

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

As used herein, the singular forms are intended to include the plural forms as well, unless the context clearly indicates otherwise. The terms "comprise," "include," and "have," when used in this application, specify the presence of stated features, numbers, operations, elements, components, or combinations thereof, but do not preclude the presence or addition of one or more other features, numbers, operations, elements, components, or combinations thereof.

Unless otherwise defined herein, all terms used herein, including technical or scientific terms, have the same meanings as those generally understood by one of ordinary skill in the art to which the disclosure of this application pertains. Terms defined in general-use dictionaries are to be interpreted as having meanings that are consistent with their meanings in the relevant art, and are not to be interpreted in an idealized or overly formal sense unless expressly so defined herein.

As used herein, the term "resin" has substantially the same meaning as the term "polymer," and thus these terms are interchangeable.

A. Toner for Developing Electrostatic Images

In one example, the toner for developing electrostatic images includes a binder and a colorant. The colorant includes a phosphor and a non-fluorescent colorant. The non-fluorescent colorant is a colorant other than a phosphor, and details thereof are set forth below.

A binder that may be used in a toner for developing electrostatic images according to one example may consist of an amorphous resin or may include a mixture of an amorphous resin and a crystalline resin. The amorphous resin and the crystalline resin may each include a mixture of two or more types of resins. The two or more types of resins may be resins consisting of the same material (e.g., the same monomer) but having different molecular weights.

A useable amorphous resin for a toner for developing electrostatic images according to one example may be a polymer that is obtained by polymerizing a monomer selected from styrenes such as styrene, para-chlorostyrene, and alpha-methylstyrene; esters having a vinyl group such as methyl acrylate, ethyl acrylate, butyl acrylate, propyl acrylate, lauryl acrylate, ethylhexyl acrylate, methyl methacrylate, ethyl methacrylate, butyl methacrylate, propyl methacrylate, lauryl methacrylate, ethylhexyl methacrylate, vinyl acetate, and vinyl benzoate; carboxylic acids or carboxylates having a double bond such as methyl maleate, ethyl maleate, and butyl maleate; olefins such as ethylene, propylene, butylene, and butadiene; carboxylic acids having a double bond such as acrylic acid, methacrylic acid, and maleic acid; or a copolymer that is obtained by copolymerizing two or more types of the monomers, or a combination of any two or more thereof.

Examples of the amorphous resin may be a non-vinyl condensed resin of an epoxy resin, a polyester resin, a polyurethane resin, a polyamide resin, a cellulose resin, or a polyether resin, a mixture of a non-vinyl condensed resin and a vinyl-based resin (that is prepared from a monomer having a carbon-carbon double bond), or a graft polymer that is obtained by polymerizing a vinyl-based monomer (having a carbon-carbon double bond) in the presence of a non-vinyl condensed polymer.

In one example, in order to control a polymerization degree and other properties, polymerization of the amorphous resin for a use of the toner for developing electrostatic images may include a dissociable vinyl-based monomer along with a monomer constituting the amorphous resin, and the amorphous resin may be a copolymer of the monomer constituting the amorphous resin and the dissociable vinyl-based monomer.

Examples of the dissociable vinyl-based monomer may be a monomer that may be a raw material of polymeric acid or polymeric base such as acrylic acid, methacrylic acid, maleic acid, cinnamate or cinnamic acid, fumaric acid, vinylsulfonic acid, ethyleneimine, vinylpyridine, and vinylamine. The polymeric acid may facilitate a polymer formation reaction.

As the dissociable vinyl-based monomer, a vinyl monomer having a carboxyl group (e.g., acrylic acid, methacrylic acid, maleic acid, cinnamate, and fumaric acid) is desirable in terms of control of a polymerization degree and a glass transition temperature.

In one example, the binder may include a mixture of an amorphous polyester-based resin and a crystalline polyester resin. In another example, the binder may include an amorphous styrene acryl-based resin.

The amorphous polyester-based resin may have a glass transition temperature of greater than or equal to about 50° C. and less than or equal to about 70° C., for example, greater than or equal to about 55° C. and less than or equal to about 65° C. When the glass transition temperature is greater than or equal to about 50° C. and less than or equal to about 70° C., a toner having improved low temperature fusing properties and storage properties may be provided. When the glass transition temperature is less than or equal to about 70° C., deterioration of the low temperature fusing properties may be prevented. When the glass transition temperature is greater than or equal to about 50° C., deterioration of storage properties may be prevented.

The glass transition temperature of the amorphous polyester-based resin may be controlled by adjusting, for example, types of a polycarboxylic acid component and a polyol component as monomers, and a combination ratio of the polycarboxylic acid component and the polyol component. The glass transition temperature of the amorphous polyester-based resin may be obtained from a differential scanning calorimetry curve obtained from measurement of differential scanning calorimetry (DSC), which will be described later.

The amorphous polyester-based resin for the binder may have a weight average molecular weight of greater than or equal to about 5000 and less than or equal to about 50000, for example, greater than or equal to about 10000 and less than or equal to about 40000. The weight average molecular weight within these ranges provides toners having improved low temperature fusing properties and storage properties. A weight average molecular weight of less than or equal to about 50000 may prevent deterioration of low temperature fusing properties. A weight average molecular weight of greater than or equal to about 5000 may prevent deterioration of storage properties. The weight average molecular weight of the amorphous polyester-based resin may be controlled by adjusting a synthesis temperature, a synthesis time, and other variables. The weight average molecular weight of the amorphous polyester-based resin may be obtained by a gel permeation chromatography (GPC) analysis, which will be described later.

The amorphous polyester-based resin for the binder may be synthesized by a dehydration condensation of the polycarboxylic acid component and the polyol component and a urethane extension of a polymer obtained by the dehydration condensation.

The amorphous polyester-based resin may be a mixture of at least two types of amorphous polyester-based polymers.

The polycarboxylic acid component for synthesis of the amorphous polyester-based resin is an organic polycarboxylic acid and examples thereof may include aliphatic carboxylic acid, aromatic carboxylic acid, acid anhydrides thereof, and lower alkyl (carbon number of greater than or equal to 1 and less than or equal to 4) esters thereof, but are not limited thereto. For example, examples of the aliphatic or alicyclic dicarboxylic acid may be a C2 to C50 alkane dicarboxylic acid (e.g., oxalic acid, malonic acid, succinic acid, adipic acid, lepargylic acid, and sebacic acid), and a C4 to C50 alkene dicarboxylic acid (e.g., alkenyl succinic acid such as dodecenyl succinic acid, maleic acid, fumaric acid, citraconic acid, mesaconic acid, itaconic acid, and glutaconic acid).

Examples of the aromatic dicarboxylic acid may be a C8 to C36 aromatic dicarboxylic acid (e.g., phthalic acid, isophthalic acid, terephthalic acid, and naphthalene dicarboxylic acid); acid anhydrides thereof, and lower alkyl (carbon number of greater than or equal to 1 and less than or equal to 4) esters thereof.

The polyol component for the amorphous polyester-based resin may be a general polyol. For example, examples of the polyol may be a C2 to C36 aliphatic diol (e.g., ethylene glycol, 1,2-propylene glycol, 1,3-propylene glycol, 1,4-butanediol, 2,3-butanediol, 1,5-pentanediol, 2,3-pentanediol, 1,6-hexanediol, 2,3-hexanediol, 3,4-hexanediol, neopentyl glycol, 1,7-heptane diol, and dodecanediol); a C4 to C36 polyalkylene glycol (e.g., diethylene glycol, dipropylene glycol, polyethylene glycol, and polypropylene glycol); an adduct of the C2 to C36 aliphatic diol with a C2 to C4 alkylene oxide (hereinafter referred to as AO, e.g., ethylene oxide, hereinafter referred to as EO, propylene oxide, hereinafter referred to as PO, and butylene oxide) (addition mole number of greater than or equal to 2 and less than or equal to 30); a C6 to C36 alicyclic diol (e.g., 1,4-cyclohexanedimethanol and hydrogenated bisphenol A); an adduct of the alicyclic diol with a C2 to C4 AO (addition mole number of greater than or equal to 2 and less than or equal to 30); and an adduct of bisphenols (e.g., bisphenol A, bisphenol F, and bisphenol S) with a C2 to C4 AO (addition mole number of greater than or equal to 2 and less than or equal to 30).

During the synthesis of the amorphous polyester-based resin, a polyisocyanate component for a urethane extension may include an organic polyisocyanate compound.

Examples of the polyisocyanate component may include diphenylmethane diisocyanate, isophorone diisocyanate, xylylene diisocyanate, p-phenylene diisocyanate, toluene diisocyanate, naphthalene diisocyanate, dibenzyldimethylmethane p,p'-diisocyanate, hexamethylene diisocyanate, norbornene diisocyanate, an isocyanurate (or a nurate) compound thereof, and an adduct thereof.

The crystalline polyester resin for the binder may have a melting point of greater than or equal to about 60° C. and less than or equal to about 80° C., for example, greater than or equal to about 65° C. and less than or equal to about 75° C. The melting point of greater than or equal to about 60° C. and less than or equal to about 80° C. may provide a toner having improved low temperature fusing properties and storage properties. When the melting point is less than or equal to about 80° C., deterioration of the low temperature fusing properties may be prevented. When the melting point is greater than or equal to about 60° C., deterioration of the storage properties may be prevented.

The melting point of the crystalline polyester resin may be controlled by adjusting types of the polycarboxylic acid component and the polyol component for the crystalline polyester resin and a combination ratio of the polycarboxylic aid component and the polyol component. The melting point of the crystalline polyester resin may be obtained from a differential scanning calorimetry curve obtained from measurement of differential scanning calorimetry (DSC), which will be described later.

The crystalline polyester resin for the binder may have a weight average molecular weight of greater than or equal to about 5000 and less than or equal to about 15000, for example, greater than or equal to about 7000 and less than or equal to about 14000. The weight average molecular weight of greater than or equal to about 5000 and less than or equal to about 15000 may provide a toner having improved low temperature fusing properties and storage properties. When the weight average molecular weight is less than or equal to about 15000, deterioration of the low temperature fusing properties may be prevented. When the weight average molecular weight is greater than or equal to about 5000, intermixing with the amorphous polyester-based resin may be avoided and deterioration of the storage properties may be prevented. The weight average molecular weight of the crystalline polyester resin may be controlled by adjusting a synthesis temperature, a synthesis time, and other variables.

The weight average molecular weight of the crystalline polyester resin may be obtained by gel permeation chromatography (GPC) measurement, which will be described later.

An amount of the crystalline polyester resin for the binder may be greater than or equal to about 5 wt % and less than or equal to about 20 wt %, for example, greater than or equal to about 7 wt % and less than or equal to about 15 wt %, based on a total weight of the binder. The amount of the crystalline polyester resin within these ranges may provide a toner having improved low temperature fusing properties and storage properties. When the amount of the crystalline polyester resin is less than or equal to about 20 wt %, deterioration of the storage properties and electrical characteristics may be prevented. When the amount of the crystalline polyester resin is greater than or equal to about 5 wt %, deterioration of the low temperature fusing properties may be prevented.

The crystalline polyester resin for the binder may be synthesized by a dehydration condensation of the polycarboxylic acid component and the polyol component. The crystalline polyester resin for the binder may include a mixture of at least two types of crystalline polyester resins. Examples of the polycarboxylic acid component for synthesis of the crystalline polyester resin may include aliphatic polycarboxylic acid. For example, the polycarboxylic acid may include oxalic acid, succinic acid, glutaric acid, adipic acid, suberic acid, decanedioic acid, dodecanedioic acid, and a combination of any two or more thereof. The polyol component for synthesis of the crystalline polyester resin may include an aliphatic polyol. For example, the polyol may include ethylene glycol, 1,4-butanediol, 1,6-hexanediol, 1,8-octanediol, 1,9-nonanediol, 1,10-decanediol, and a combination of any two or more thereof.

In another example, an amorphous styrene acryl (or vinyl)-based polymer (hereinafter, styrene acryl-based polymer) for the binder may include a copolymer of a styrene component and an acryl (or vinyl)-based component (hereinafter, acryl-based component), a polymer polymerized using only styrene component as a monomer, a polymer polymerized using only acryl-based component as a monomer, or a combination of any two or more thereof. The amorphous styrene acryl-based polymer for the binder may have a glass transition temperature of greater than or equal to about 50° C. and less than or equal to about 70° C., for example, greater than or equal to about 55° C. and less than or equal to about 65° C. The glass transition temperature within these ranges may provide a toner having improved low temperature fusing properties and storage properties. When the glass transition temperature is greater than or equal to about 70° C., deterioration of the low temperature fusing properties may be prevented. When the glass transition temperature is less than or equal to about 50° C., deterioration of the storage properties may be prevented.

The glass transition temperature of the amorphous styrene acryl-based polymer may be controlled by adjusting types of the styrene component and the acryl-based component as monomers of the amorphous styrene acryl-based polymer, a combination ratio of the styrene component and the acryl-based component, and other variables. The glass transition temperature of amorphous styrene acryl-based polymer may be obtained from a differential scanning calorimetry curve obtained from measurement of differential scanning calorimetry (DSC), which will be described later.

The amorphous styrene acryl-based polymer for the binder may have a weight average molecular weight of greater than or equal to about 300000 and less than or equal to about 600000, for example, greater than or equal to about 350000 and less than or equal to about 550000. The weight average molecular weight within these ranges may provide a toner having improved low temperature fusing properties and storage properties. When the weight average molecular weight is less than or equal to about 600000, deterioration of the low temperature fusing properties may be prevented. When the weight average molecular weight is greater than or equal to about 300000, deterioration of the storage properties may be prevented.

The weight average molecular weight of the amorphous styrene acryl-based polymer may be controlled by adjusting a synthesis temperature, a synthesis time, and other variables. The weight average molecular weight of the amorphous styrene acryl-based polymer may be obtained by gel permeation chromatography (GPC) measurement, which will be described later.

The amorphous styrene acryl-based polymer for the binder may include a polymer prepared by an addition polymerization of a styrene component and an acryl-based component, a polymer prepared by an addition polymerization of only styrene component, a polymer prepared by an addition polymerization of only acryl-based component, or a combination of any two or more thereof. The amorphous styrene acryl-based polymer for the binder may include a mixture of two or more types of amorphous styrene acryl-based polymers. Examples of the styrene component for synthesis of the amorphous styrene acryl-based polymer may be styrene, para-chlorostyrene, and alpha-methylstyrene. Examples of the acryl-based component for synthesis of the amorphous styrene acryl-based polymer may include esters having a vinyl group, carboxylic acids or carboxylates having a double bond, olefins, or a combination of any two or more thereof.

Examples of the acryl-based component may be methyl acrylate, ethyl acrylate, butyl acrylate, propyl acrylate, lauryl acrylate, ethylhexyl acrylate, methyl methacrylate, ethyl methacrylate, butyl methacrylate, propyl methacrylate, lauryl methacrylate, ethylhexyl methacrylate, vinyl acetate, vinyl benzoate, methyl maleate, ethyl maleate, butyl maleate, acrylic acid, methacrylic acid, maleic acid, ethylene, propylene, butylene, butadiene, or a combination of any two or more thereof.

The toner for developing electrostatic images according to an example includes a phosphor including either one or both of a nitride and an oxynitride each including an alkaline-earth metal, silicon, and an element that functions as an activator (hereinafter referred to as an activator element). The activator element is an element that functions as a light emitting center (color center) in the phosphor. The nitride may include an $M_2Si_5N_5$-based nitride (wherein M is an alkaline-earth metal and an activator element). The oxynitride may include an $MSi_2O_2N_2$ oxynitride (wherein M is an alkaline-earth metal and an activator element), or an $M_2(Si,Al)_5(N,O)_8$ oxynitride (wherein M is an alkaline-earth metal and an activator element), or a combination thereof. The phosphor may consist of a nitride or may consist of an oxynitride. The phosphor may include both a nitride and an oxynitride.

The phosphor may include foreign particles (e.g., impurities) in addition to the nitride and the oxynitride within ranges in which they do not have an unfavorable effect on light emitting characteristics of the phosphor. Examples of the alkaline-earth metal included in the nitride and the oxynitride may include calcium (Ca), strontium (Sr), barium (Ba), and a combination of any two or more thereof. The activator element included in the nitride and the oxynitride may include europium (Eu), cerium (Ce), manganese (Mn), praseodymium (Pr), neodymium (Nd), samarium (Sm), terbium (Tb), dysprosium (Dy), holmium (Ho), erbium (Er), thulium (Tm), ytterbium (Yb), and a combination of any two or more thereof.

The phosphor included in the toner for developing electrostatic images of an example has the following characteristics (1) and (2), and thereby the phosphor has improved light emitting characteristics and has a small particle diameter and widens a color expression region due to the phosphor:

Characteristic (1): a volume average particle diameter may be greater than or equal to about 50 nm and less than or equal to about 400 nm.

Characteristic (2): an internal quantum efficiency at an excitation wavelength of 450 nm is greater than or equal to about 60%.

The volume average particle diameter of the phosphor may be greater than or equal to about 50 nm and less than or equal to about 400 nm, for example, greater than or equal to about 100 nm and less than or equal to about 350 nm, as described above. The volume average particle diameter within these ranges may provide a phosphor having a small particle diameter. When the volume average particle diameter is less than or equal to about 400 nm, it may be accepted in the toner. When the volume average particle diameter is greater than or equal to 50 nm, a difficulty in preparing the phosphor may be avoided. The volume average particle diameter of the phosphor may be measured by a dynamic light scattering method, which will be described later.

The internal quantum efficiency at an excitation wavelength of 450 nm may be greater than or equal to about 60%, for example, greater than or equal to about 70%, as described above. The internal quantum efficiency within these ranges provides a toner having improved light emitting characteristics. When the internal quantum efficiency is greater than or equal to about 60%, a color reproduction region of the toner may be relatively easily widened. The internal quantum efficiency of the phosphor may be obtained by a photoluminescence (PL) method, which will be described later.

In the phosphor included in the toner for developing electrostatic images of an example, an oxynitride in the phosphor represented by a composition formula $MSi_2O_2N_2$ has the same crystal structure as $SrSi_2O_2N_2$ and has a light emitting peak wavelength within a range of greater than or equal to about 530 nm and less than or equal to about 570 nm. M is an alkaline-earth metal and an activator element, the alkaline-earth metal is at least one selected from Ca, Sr, and Ba and includes at least Sr, and the activator element is at least one selected from Eu and Ce and includes at least Eu.

The Sr may be included in an amount of greater than or equal to about 15 mol % and less than or equal to about 99 mol %, for example, greater than or equal to about 20 mol % and less than or equal to about 95 mol %, based on a sum of M. The activator element may be included in an amount of greater than or equal to about 1 mol % and less than or equal to about 20 mol %, for example, greater than or equal to about 5 mol % and less than or equal to about 15 mol %, based on a sum of M. When the phosphor includes about 15 mol % or greater of Sr based on a sum of the element M, deterioration of a melting point of an $MSi_2O_2N_2$-based oxynitride of the target composition may be prevented. The phosphor including the $MSi_2O_2N_2$-based oxynitride of the target composition may be relatively easily prepared.

When the phosphor includes about 99 mol % or less of Sr based on a sum of the element M, reduction of an amount of the activator element may be prevented, and therefore, the phosphor may exhibit improved light emitting characteristics.

When the phosphor includes about 1 mol % or greater of the activator element based on a sum of the element M, an amount of the activator element may be ensured, and therefore improved light emitting characteristics may be realized.

When the phosphor includes about 20 mol % or less of the activator element based on a sum of the element M, generation of a concentration extinction may be prevented and therefore improved light emitting characteristics may be realized.

A toner for developing electrostatic images of an example may include a non-fluorescent colorant as a colorant in addition to the phosphor. Types of the non-fluorescent colorant are not particularly limited, and examples of the non-fluorescent colorant may include known dyes and pigments. For example, the non-fluorescent colorant may be carbon black, nigrosine dye, iron black, Naphthol Yellow S, Hansa Yellow (10G, 5G, G), cadmium yellow, yellow iron oxide, loess, chrome yellow, titanium yellow, poly azo yellow such as disazo yellow, oil yellow, Hansa yellow (GR, A, RN, R), Pigment Yellow L, benzidine yellow (G, GR), Permanent Yellow (NCG), Vulcan Fast Yellow (5G, R), Tartrazine Lake, quinoline yellow lake, anthrazane yellow BGL, isoindolinone yellow, red iron oxide, red lead, Namarishu, cadmium red, cadmium-mercury red, antimony vermilion, Permanent Red 4R, Para Red, file save Red, p-chloroorthonitroaniline Red, Lithol Fast Scarlet G, Brilliant Fast Scarlet, Brilliant carmine BS, Permanent Red (F2R, F4R, FRL, FRLL, F4RH), Fast Scarlet VD, Vulcan Fast Rubin B, brilliant scarlet G, Lithol Rubine GX, Permanent Red FSR, Brilliant Carmine 6B, Pigment Scarlet 3B, Bordeaux 5B, Toluidine Maroon, permanent Bordeaux F2K, Helio Bordeaux BL, Bordeaux 10B, Bon Maroon Light, Bon Maroon medium, eosin lake, rhodamine lake B, Rhodamine Lake Y, alizarin lake, thioindigo Red B, Thioindigo Maroon, Oil Red, quinacridone red, pyrazolone red, polyazo red, chrome vermilion, benzidine orange, perinone orange, oil orange, cobalt blue, cerulean blue, alkali blue lake, peacock blue lake, Victoria Blue Lake, metal-free phthalocyanine blue, phthalocyanine blue, Fast Sky Blue, Indanthrene Blue (RS, BC), indigo, ultramarine blue, Prussian blue, anthraquinone blue, fast violet B, methyl violet lake, cobalt violet, manganese violet, dioxane violet, anthraquinone violet, chrome green, zinc green, chromium oxide, viridian, emerald green, Pigment Green B, Naphthol Green B, Green Gold, acid green lake, malachite green lake, phthalocyanine green, anthraquinone green, titanium oxide, zinc oxide, and lithopone.

When the phosphor included in the toner for developing electrostatic images of an example emits yellow light, naphthol yellow S, Hansa yellow (10G, 5G, G), cadmium yellow, yellow iron oxide, loess, chrome yellow, titanium yellow, poly azo yellow, oil yellow, Hansa yellow (GR, A, RN, R), Pigment Yellow L, benzidine yellow (G, GR), Permanent yellow (NCG), Vulcan Fast Yellow (5G, R), Tartrazine Lake, quinoline yellow lake, anthrazane yellow BGL, isoindolinone yellow, or a mixture of any two or more thereof may be used as a non-fluorescent colorant.

An amount of the colorant (i.e., a sum of contents of the phosphor and the non-fluorescent colorant) may be greater than or equal to about 3.5 wt % and less than or equal to about 7 wt %, for example, greater than or equal to about 4 wt % and less than or equal to about 6.5 wt %, based on a total amount of the toner. When amount of the colorant is within these ranges, a color of the toner may be developed by a small content of the colorant. When the amount of the colorant is less than or equal to about 7 wt %, relatively clear color of the toner may be provided. When the amount of the colorant is greater than or equal to about 3.5 wt %, a color of the toner may be developed. In the toner, the amount of the binder is not particularly limited and may be selected appropriately. For example, the amount of the binder may be greater than or equal to about 10 wt %, greater than or equal to about 15 wt %, greater than or equal to about 20 wt %, greater than or equal to about 30 wt %, greater than or equal to about 40 wt %, greater than or equal to about 50 wt %, greater than or equal to about 60 wt %, greater than or equal to about 70 wt %, greater than or equal to about 80 wt %, greater than or equal to about 85 wt %, greater than or equal to about 86 wt %, greater than or equal to about 87 wt %, greater than or equal to about 88 wt %, greater than or equal to about 89 wt %, greater than or equal to about 90 wt %, greater than or equal to about 91 wt %, greater than or equal to about 92 wt %, greater than or equal to about 93 wt %, greater than or equal to about 93.5 wt % based on a total weight of the toner. The amount of the binder may be less than or equal to about 96.5 wt %, less than or equal to about 96.4 wt %, less than or equal to about 96.3 wt %, less than or equal to about 96.2 wt %, less than or equal to about 96.1 wt %, less than or equal to about 96 wt %, less than or equal to about 95 wt %, less than or equal to about 94 wt %, less than or equal to about 93 wt %, less than or equal to about 92 wt %, less than or equal to about 91 wt %, less than or equal to about 90 wt %, less than or equal to about 89 wt %, less than or equal to about 88 wt %, less than or equal to about 87 wt %, less than or equal to about 86 wt %, less than or equal to about 85 wt %, less than or equal to about 84 wt %, less than or equal to about 83 wt %, less than or equal to about 82 wt %, less than or equal to about 81 wt %, less than or equal to about 80 wt %, less than or equal to about 75 wt %, less than or equal to about 70 wt %, less than or equal to about 65 wt %, less than or equal to about 60 wt %, less than or equal to about 55 wt % based on a total weight of the toner.

An amount of the phosphor may be greater than or equal to about 0.25 wt % and less than or equal to about 4.55 wt %, for example, greater than or equal to about 0.5 wt % and less than or equal to about 3 wt %, based on a total amount of the toner. When the amount of the phosphor is within these ranges, a color expression region of the toner may be widened without causing a change in the toner color. When the amount of the phosphor is less than or equal to about 4.55 wt %, a color mismatch of the toner may be prevented. When the amount of the phosphor is greater than or equal to about 0.25 wt %, a phosphor inclusion effect may be relatively easily obtained.

The toner for developing electrostatic images according to an example may include a release agent and a charge control agent. Examples of the release agent of the toner for developing electrostatic images of an example may be a solid paraffin wax, microcrystalline wax, rice wax, fatty acid amide-based wax, fatty acid-based wax, aliphatic mono ketones, fatty acid metal salt-based wax, fatty acid ester-based wax, partially saponified fatty acid ester-based wax, silicon varnish, higher alcohols, and Carnauba wax. Also, a polyolefin such as low molecular weight polyethylene, polypropylene may be used as the release agent.

The charge control agent for the toner for developing electrostatic images of an example may be a nigrosine dye, a triphenylmethane-based dye, a chromium-containing metal complex dye, a molybdenum acid chelate pigment, a rhodamine-based dye, alkoxy-based amine, a quaternary ammonium salt (including a fluorine modified quaternary ammonium salt), alkyl amide, an elementary substance or a compound of phosphorus, an elementary substance or a compound of tungsten, a fluorine-based activator, a metal salicylate salt, a metal salt of a salicylic acid derivative, or a combination of any two or more thereof. In the toner, each of the amounts of the other components (e.g., the release agent, the charge control agent, the surfactant, the agglomeration agent, and any other components) are not particularly limited and may be selected appropriately. For example, the amount(s) may be greater than or equal to about 0.1 wt %, for example, greater than or equal to about 1 wt %, greater than or equal to about 2 wt %, based on a total weight of the toner. For example, the amount(s) may be less than or equal to about 50 wt %, for example, less than or equal to about 40 wt %, less than or equal to about 30 wt %, less than or equal to about 20 wt %, or less than or equal to about 10 wt % based on a total weight of the toner.

For example, the charge control agent may include BONTRON® 03 of the nigrosine dye; BONTRON® P-51 of a quaternary ammonium salt; BONTRON® S-34 of a metal-containing azo dye; BONTRON® E-82 of oxynaphthoic acid metal complex; BONTRON® E-84 of a salicylate metal complex; BONTRON® E-89 of a phenolic condensate (manufactured by Orient Chemical Industries, Ltd.); TP-302 of a quaternary ammonium salt molybdenum complex; TP-415 (manufactured by Hodogaya Chemical Co. Ltd.); Copy Charge® PSY VP2038 of a quaternary ammonium salt; Copy Blue PR of a triphenylmethane derivative; Copy Charge NEG VP2036 of a quaternary ammonium salt;

Copy Charge NX VP434 (manufactured by Hoechst AG); LRA-901; a boron complex LR-147 (manufactured by Japan Carlit Co., Ltd.), copper phthalocyanine; perylene; quinacridone; an azo-based pigment; or a polymer-based compound having a functional group such as a sulfonic acid group, a carboxyl group, or a quaternary ammonium salt or a quaternary ammonium group, or a combination of any two or more thereof.

A toner for developing electrostatic images of an example includes an iron element, a silicon element, and a sulfur element. An amount of the iron is greater than or equal to about $1.0\times10^3$ ppm and less than or equal to about $1.0\times10^4$ ppm, an amount of the silicon is greater than or equal to about $1.0\times10^3$ ppm and less than or equal to about $5.0\times10^4$ ppm, and an amount of the sulfur is greater than or equal to about 500 ppm and less than or equal to about 3000 ppm.

The iron element and the silicon element are components derived from the post-described agglomerating agent and the sulfur element is a component derived from the post-described catalyst and agglomerating agent. Therefore, in the toner for developing electrostatic images, the amount of the iron and the amount of silicon may be controlled by adjusting the type and the amount of the agglomerating agent, and the amount of the sulfur element may be controlled by adjusting the types and the amounts of the catalyst and the agglomerating agent.

The amount of the iron element of the toner for developing electrostatic images is greater than or equal to about $1.0\times10^3$ ppm and less than or equal to about $1.0\times10^4$ ppm, for example, greater than or equal to about 1000 ppm and less than or equal to about 5000 ppm, as described above.

By including the iron element of the content within these ranges, it may be used as a toner for developing electrostatic images. When the amount of the iron element is less than or equal to about $1.0\times10^4$ ppm, an excessive increase of a minimum fusing temperature (MFT) of the toner may be prevented. When the amount of the iron element is greater than or equal to about $1.0\times10^3$ ppm, formation of a toner particle may be easily made.

The amount of the silicon element of the toner for developing electrostatic images is greater than or equal to about $1.0\times10^3$ ppm and less than or equal to about $5.0\times10^4$ ppm (e.g., less than or equal to about $5.0\times10^3$ ppm). By including the silicon element in an amount of the aforementioned the range, it may be used as a toner for developing electrostatic images. When the amount of the silicon element is less than or equal to about $5.0\times10^4$ ppm (e.g., less than or equal to about $5.0\times10^3$ ppm), an excessive increase of a minimum fusing temperature (MFT) of the toner may be prevented. When the amount of the silicon element is greater than or equal to about $1.0\times10^3$ ppm, formation of a toner particle may be easily accomplished.

The amount of the sulfur element of the toner for developing electrostatic images may be greater than or equal to about 500 ppm and less than or equal to about 3000 ppm, for example, greater than or equal to about 1000 ppm and less than or equal to about 3000 ppm, as described above.

By including the sulfur element in an amount of the aforementioned range, it may be used as a toner for developing electrostatic images. When the amount of the sulfur element is less than or equal to about 3000 ppm, deterioration of electrical characteristics of the toner may be prevented. When the amount of the sulfur element is greater than or equal to about 500 ppm, formation of a toner particle may be easily accomplished. Each element content in the toner for developing electrostatic images may be analyzed in a fluorescent X-ray analysis method, which will be described later.

The toner for developing electrostatic images of an example may have a coating layer formed of a binder on the surface. The coating layer may stabilize a electric charge quantity of the toner and thus prevent damage by a friction force when the toner is charged. When the binder includes an amorphous polyester-based resin and a crystalline polyester resin, the coating layer may be formed of the amorphous polyester-based resin. When the binder is an amorphous styrene acryl-based polymer, the coating layer may be formed of the amorphous styrene acryl-based polymer. If present, the coating layer has a thickness of greater than or equal to about 0.2 μm and less than or equal to about 1.0 μm. When the thickness is in a range of less than or equal to about 1.0 μm, a core may not be reduced but maintain a predetermined particle diameter, and a negative influence on dispersibility of a colorant included in the core may be prevented. The coating layer having a thickness of greater than or equal to about 0.2 μm may prevent friction damage during charging of the toner. The thickness of the coating layer may be measured with a transmission electron microscope.

The toner for developing electrostatic images of an example may have a volume average particle diameter of greater than or equal to about 3 μm and less than or equal to about 9 μm, for example, greater than or equal to about 4 μm and less than or equal to about 7 μm. Within these ranges a dense image may be easily formed. When the volume average particle diameter is less than or equal to about 9 μm, a dense image may be easily made. When the volume average particle diameter is greater than or equal to about 3 μm, the toner is easy to handle and is easily developed.

The toner for developing electrostatic images of an example has a coefficient of variation of a particle diameter of greater than or equal to about 15% and less than or equal to about 25%. When the toner has the coefficient of variation of a particle diameter within these ranges, a particle diameter of the toner becomes uniform and a dense image may be easily formed. When the coefficient of variation of a particle diameter exceeds 25%, a dense image may not be formed easily due to presence of a toner having a large particle diameter. A toner having a coefficient of variation of a particle diameter of less than 15% would not be easily prepared. The volume average particle diameter and the coefficient of variation of a particle diameter of the toner for developing electrostatic images may be controlled by adjusting conditions for the toner production (e.g., an agglomeration time, an agglomeration temperature, and other variables). The volume average particle diameter and the coefficient of variation of a particle diameter of the toner for developing electrostatic images may be measured by a pore electrical resistance method, which will be described later.

The toner for developing electrostatic images of an example may have a weight average molecular weight of greater than or equal to about 7000 and less than or equal to about 50000, for example, greater than or equal to about 10000 and less than or equal to about 40000. The weight average molecular weight within these ranges may contribute to improvement of a low temperature fusing properties and storage properties of the toner. When the weight average molecular weight is less than or equal to about 50000, a melting speed is lowered and deterioration of a low temperature fusing properties may be prevented. When the weight average molecular weight is less than or equal to about 50000, a melting viscosity is not excessively increased and deterioration of a gloss of produced images may be prevented. When the weight average molecular weight is greater than or equal to about 7000, deterioration of storage properties may be prevented. When the weight average molecular weight is greater than or equal to about 7000, excessive deterioration of strength may be prevented and friction damage during charging of the toner may be prevented. The weight average molecular weight of the toner for developing electrostatic images may be controlled by adjusting a synthesis temperature, a synthesis time, and other variables. The weight average molecular weight of the toner for developing electrostatic images may be obtained by a gel permeation chromatography (GPC) measurement, which will be described later.

A ratio of a weight average molecular weight to a number average molecular weight of the toner for developing electrostatic images of an example may be greater than or equal to about 7.0 and less than or equal to about 17.0, for example, greater than or equal to about 9.0 and less than or equal to about 16.0. When the ratio of a weight average molecular weight to a number average molecular weight is within these ranges, a molecular weight deviation of a resin constituting the toner is small and a toner having improved low temperature fusing properties and storage properties is realized. When the ratio of a weight average molecular weight to a number average molecular weight exceeds 17.0, it may have unfavorable effects on a molecular weight deviation of a resin constituting the toner, low temperature fusing properties, storage properties, a gloss of images, and other properties. A toner having a ratio of a weight average molecular weight to a number average molecular weight of less than about 7.0 is difficult to produce.

The ratio of a weight average molecular weight to a number average molecular weight of the toner for developing electrostatic images may be controlled by adjusting a synthesis temperature, a synthesis time, and other variables.

The ratio of a weight average molecular weight to a number average molecular weight of the toner for developing electrostatic images may be obtained by gel permeation chromatography (GPC) measurement, which will be described later.

A glass transition temperature of the toner for developing electrostatic images of an example may be greater than or equal to about 50° C. and less than or equal to about 70° C., for example, greater than or equal to about 50° C. and less than or equal to about 60° C. When the glass transition temperature is within these ranges, the toner may exhibit improved low temperature fusing properties and improved storage properties. When the glass transition temperature is less than or equal to about 70° C., deterioration of the low temperature fusing properties may be prevented. When the glass transition temperature is greater than or equal to about 50° C., deterioration of the storage properties may be prevented.

The glass transition temperature of the toner for developing electrostatic images may be controlled by adjusting a glass transition temperature of the binder and other variables. The glass transition temperature of toner for developing electrostatic images may be obtained from a differential scanning calorimetry curve obtained from measurement of differential scanning calorimetry (DSC), which will be described later.

An acid value of the toner for developing electrostatic images may be greater than or equal to about 3 mg KOH/g and less than or equal to about 25 mg KOH/g, for example, greater than or equal to about 5 mg KOH/g and less than or equal to about 20 mg KOH/g. The acid value within these ranges may provide a toner having improved charge properties and charge maintenance/support properties. When the acid value exceeds 25 mg KOH/g, charge maintenance/support properties may be deteriorated. When the acid value is less than 3 mg KOH/g, charge properties may be deteriorated. The acid value of the toner for developing electrostatic images may be controlled by adjusting an acid value of the binder. The acid value of the toner for developing electrostatic images may be measured by a neutralization titration method, which will be described later.

B. Method of Producing Toner for Developing Electrostatic Images

A method of producing the toner for developing electrostatic images of an example includes a binder latex forming process, a phosphor dispersion forming process, a non-fluorescent colorant dispersion forming process, a mixed solution forming process, a primary agglomeration particle forming process, a coated agglomeration particle forming process, and a fusion and unification process.

Binder Latex Forming Process

The binder latex forming process is a process of forming the binder latex. Hereinafter, the binder latex forming process is described regarding a first example that uses a mixture of an amorphous polyester-based resin and a crystalline polyester resin as the binder and a second example that uses an amorphous styrene acryl-based polymer.

(1) First Example

In the first example, the binder latex forming process includes a synthesis process of the amorphous polyester-based resin, a process of forming the amorphous polyester-based resin latex, a synthesis process of the crystalline polyester resin, and a process of forming the crystalline polyester resin latex.

<Synthesis Process of Amorphous Polyester-Based Resin>

The synthesis process of the amorphous polyester-based resin includes a dehydration condensation of a polycarboxylic acid component and a polyol component in the presence of a catalyst at a temperature of less than or equal to about 150° C., a urethane extending process of a resin obtained by the dehydration condensation, and a synthesis process of the amorphous polyester-based resin.

The synthesis process of the amorphous polyester-based resin includes an esterification process and a urethane extending process.

(Esterification Process)

In the esterification process, first, the polycarboxylic acid component, the polyol component, and the catalyst are put in a reaction vessel. The polycarboxylic acid component for synthesis of the amorphous polyester-based resin may include general organic polycarboxylic acid such as aliphatic carboxylic acid, aromatic carboxylic acid, acid anhydride thereof, and lower alkyl (carbon number of greater than or equal to 1 and less than or equal to 4) esters, as described above.

The polycarboxylic acid component may include a single compound or a mixture of at least two compounds. As the polyol component for synthesis of the amorphous polyester-based resin, a general polyol may be included as described above. The polyol component may be a single compound or a mixture of at least two compounds.

The used amounts of the polycarboxylic acid component and the polyol component may be appropriately determined considering properties that the amorphous polyester-based resin needs.

The used amount of the polycarboxylic acid component may be greater than or equal to about 7 wt % and less than or equal to about 35 wt %, for example, greater than or equal to about 10 wt % and less than or equal to about 30 wt %, based on a sum of the polycarboxylic acid component and the polyol component. When the polycarboxylic acid component is used within these ranges, a glass transition temperature and a molecular weight of the amorphous polyester-based resin may be controlled within the ranges described above. When the polycarboxylic acid component is used in an amount of less than or equal to about 35 wt %, a molecular weight of the amorphous polyester-based resin may be controlled within the ranges described above. When the polycarboxylic acid component is used in an amount of greater than or equal to about 7 wt %, a molecular weight of the amorphous polyester-based resin may be controlled within the ranges described above.

A catalyst capable of being used for synthesis of the amorphous polyester-based resin may include sulfur and optionally fluorine. The catalyst may include at least one element selected from sulfur and fluorine so that at least sulfur may be included. The catalyst may include paratoluenesulfonic acid 1 hydrate, bis (1,1,2,2,3,3,4,4,4-nonafluoro-1-butane sulfonyl)imide, and scandium(III) triflate.

The catalyst may be a single compound or a mixture of at least two compounds. A use amount of the catalyst may be appropriately determined considering a content range of a sulfur element that the toner needs. For example, a use amount of the catalyst may be greater than or equal to about 0.1 wt % and less than or equal to about 2.0 wt %, for example, greater than or equal to about 0.5 wt % and less than or equal to about 1.5 wt %, based on a sum of the polycarboxylic acid component, the polyol component, and the catalyst. When the catalyst is used within these ranges, an amount of the sulfur in the toner may be controlled within the ranges described above. When a use amount of the catalyst exceeds 2.0 wt %, a side reaction may occur and it is not desirable for coloring the amorphous polyester-based resin. When a use amount of the catalyst is less than 0.1 wt %, a molecular weight that is necessary for the amorphous polyester-based resin is difficult to ensure.

Subsequently, in the esterification process, an inert gas atmosphere is formed within a reaction vessel, a mixture of the polycarboxylic acid component and the polyol component, and the catalyst is heated to be dissolved, and thereby forming a mixture solution including the polycarboxylic acid component, the polyol component, and the catalyst. Then, the mixed solution is heated at a predetermined temperature of less than or equal to about 150° C. The temperature is a synthesis temperature of the polyester resin. Then, the pressure in the reaction vessel is reduced to substantially a vacuum, and a dehydration condensation reaction of the polycarboxylic acid component and the polyol component is performed at a synthesis temperature of the polyester resin for a predetermined time to form the polyester resin.

By adjusting the type of the monomer and the combination ratio and adjusting the type of the catalyst, the synthesis temperature of the polyester resin may be lowered. The synthesis temperature of the polyester resin may be less than or equal to about 150° C., for example, greater than or equal to about 80° C. and less than or equal to about 100° C., as described above. The synthesis temperature within the aforementioned range may reduce an energy consumption amount during synthesis of the polyester resin. When the synthesis temperature exceeds 150° C., an energy consumption for the synthesis of the polyester resin may become larger. When the synthesis temperature is less than 80° C., a synthesis time of the polyester resin may become longer.

(Urethane Extending Process)

In the urethane extending process, first, after returning a pressure inside the reaction vessel to a normal pressure, the polyisocyanate component and an organic solvent are added to a solution wherein the polyester resin is formed. The polyisocyanate component for synthesis of the amorphous polyester-based resin may include a general organic polyisocyanate compound as described above. The polyisocyanate component may be a single compound or a mixture of at least two compounds. The used amount of the polyisocyanate component may be appropriately determined considering properties that the amorphous polyester-based resin needs.

For example, the amount of the polyisocyanate component may be greater than or equal to about 3 wt % and less than or equal to about 30 wt %, for example, greater than or equal to about 5 wt % and less than or equal to about 15 wt %, based on a sum of the polycarboxylic acid component and the polyol component.

When the use amount of the polyisocyanate component is within these ranges, a glass transition temperature and a molecular weight of the amorphous polyester-based resin may be controlled within the ranges described above. When the amount of the polyisocyanate component exceeds 30 wt %, an electrical charge quantity of the toner may be lowered. When the amount of the polyisocyanate component is less than 3 wt %, a molecular weight that is necessary for the amorphous polyester-based resin is difficult to ensure.

Subsequently, in the urethane extending process, an inert gas atmosphere is formed within a reaction vessel, and the polyester resin reacts with a urethane extending component at a predetermined temperature for a predetermined time to form the amorphous polyester-based resin.

A reaction temperature where the urethane extending of the polyester resin is performed may be appropriately determined considering properties that the amorphous polyester-based resin needs. For example, the reaction temperature may be greater than or equal to about 60° C. and less than or equal to about 100° C., for example, greater than or equal to about 80° C. and less than or equal to about 100° C. The reaction temperature within these ranges may reduce an energy consumption amount and may ensure properties that are necessary for the amorphous polyester-based resin. When the reaction temperature exceeds about 100° C., an energy consumption amount may become larger. When the reaction temperature is less than about 60° C., a reaction time may become longer.

<Process of Forming Amorphous Polyester-Based Resin Latex>

The present process is a process of forming the amorphous polyester-based resin latex.

In the process of forming amorphous polyester-based resin latex, first, the amorphous polyester-based resin and an organic solvent are put in a reaction vessel and the amorphous polyester-based resin is dissolved in the organic solvent. The amorphous polyester-based resin may be a single compound or a mixture of at least two compounds. The used amount of the amorphous polyester-based resin may be appropriately determined considering viscosity and other properties. Examples of the organic solvent useable for formation of the amorphous polyester-based resin latex may include methyl ethyl ketone, isopropyl alcohol, ethyl acetate, and a combination of any two or more thereof.

In the process of forming amorphous polyester-based resin latex, subsequently, an alkaline solution is slowly added while stirring a solution including the amorphous polyester-based resin, and water is added at a predetermined speed to form emulsion liquid. The alkaline solution is added to neutralize the solution including the amorphous polyester-based resin. The alkaline solution useable for formation of the amorphous polyester-based resin latex may be an ammonia aqueous solution, an amine compound aqueous solution, or a combination of any two or more thereof. The alkaline solution may be a solution of a single compound or a solution of a mixture of at least two compounds. The addition amount of the alkaline solution may be appropriately determined by considering acidity of the solution including the amorphous polyester-based resin. The addition amount of the water may be appropriately determined by considering the particle diameter of the obtained latex. The addition speed of the water may be appropriately determined by considering a particle diameter distribution of the latex.

Subsequently, the organic solvent is removed from the emulsion so that a concentration of the solid amorphous polyester-based resin may be a predetermined value. The organic solvent is removed from the emulsion to obtain the amorphous polyester-based resin latex. The removal of the organic solvent may be performed by a reduced pressure distillation method. In the amorphous polyester-based resin latex, the concentration of the amorphous polyester-based resin may be appropriately determined considering viscosity, storage stability, economy, and other variables. For example, the concentration of the amorphous polyester-based resin may be greater than or equal to about 10 wt % and less than or equal to about 50 wt %, for example, greater than or equal to about 20 wt % and less than or equal to about 40 wt %.

<Synthesis Process of Crystalline Polyester Resin>

The synthesis process of the crystalline polyester resin includes a dehydration condensation of the polycarboxylic acid component and the polyol component in the presence of a catalyst at a temperature of less than or equal to about 150° C. to synthesize the crystalline polyester resin. In the synthesis process of the crystalline polyester resin, first, the polycarboxylic acid component, the polyol component, and a catalyst are put in a reaction vessel. The polycarboxylic acid component for synthesis of the crystalline polyester resin may include the aliphatic polycarboxylic acid as described above. The polycarboxylic acid component may be a single compound or a mixture of at least two compounds. The polyol component for the synthesis of the crystalline polyester resin may be aliphatic polyol as described above. The polyol component may be a single a compound or a mixture of at least two compounds. A use amount of the polycarboxylic acid component and the polyol component may be desirably determined considering properties that the crystalline polyester resin needs. For example, a use amount of the polycarboxylic acid component may be greater than or equal to about 35 wt % and less than or equal to about 75 wt %, for example, greater than or equal to about 45 wt % and less than or equal to about 60 wt %, based on a sum of the polycarboxylic acid component and the polyol component.

When the amount of the polycarboxylic acid component is within these ranges, a melting point and a molecular weight of the crystalline polyester resin may be controlled within the ranges described above. When the polycarboxylic acid component exceeds 75 wt %, a molecular weight that is necessary for the crystalline polyester resin is difficult to control. When the amount of the polycarboxylic acid component is less than 35 wt %, a molecular weight that is necessary for the crystalline polyester resin may not be ensured.

The catalyst that may be used for the synthesis of the crystalline polyester resin may include at least one element selected from sulfur and fluorine and also include at least sulfur element. The catalyst may include a single compound or a mixture of at least two compounds. The catalyst may include a strong acid compound. For example, the catalyst may include paratoluenesulfonic acid 1 hydrate, bis(1,1,2,2,3,3,4,4,4-nonafluoro-1-butane sulfonyl)imide, scandium (III) triflate, or a mixture of any two or more thereof. The use amount of the catalyst is suitably determined by considering the content range of the sulfur element that is necessary for the toner. For example, the use amount of the catalyst may be greater than or equal to about 0.05 wt % and less than or equal to about 2.0 wt %, for example, greater than or equal to about 0.1 wt % and less than or equal to about 1.5 wt %, based on a sum of the polycarboxylic acid component, the polyol component, and the catalyst. When the use amount of the catalyst is within the aforementioned ranges, the sulfur content in the toner may be controlled within the ranges. When the use amount of the catalyst exceeds 2.0 wt %, a side reaction may occur and the crystalline polyester resin may be colored. When the use amount of the catalyst is less than 0.05 wt %, a molecular weight that is necessary for the crystalline polyester resin may not be ensured.

In the synthesis process of the crystalline polyester resin, next, an inert gas atmosphere is formed within a reaction vessel, a mixture of the polycarboxylic acid component, the polyol component and the catalyst is heated to be dissolved to form a mixed solution including the polycarboxylic acid component, the polyol component, and the catalyst. Then, the mixed solution is heated at a predetermined temperature of less than or equal to about 100° C. The temperature is a synthesis temperature of the polyester resin. Then, the pressure in the reaction vessel is reduced to substantially a vacuum, and a dehydration condensation reaction of the polycarboxylic acid component and the polyol component is performed at a synthesis temperature of the polyester resin for a predetermined time to form the crystalline polyester resin. By adjusting the type of the monomer and the combination ratio and adjusting the type of the catalyst, the synthesis temperature of the polyester resin may be lowered. The synthesis temperature of the polyester resin may be less than or equal to about 100° C., for example, greater than or equal to about 80° C. and less than or equal to about 100° C., as described above. The synthesis temperature within the ranges may reduce an energy consumption amount during synthesis of the polyester resin. When the synthesis temperature exceeds 100° C., an energy consumption amount of the polyester resin may become larger. When the synthesis temperature is less than 80° C., a synthesis time of the polyester resin may become longer.

<Process of Forming Crystalline Polyester Resin Latex>

The present process is a process of forming the crystalline polyester resin latex. In the process of forming crystalline polyester resin latex, first, the crystalline polyester resin and an organic solvent are put in a reaction vessel, and the crystalline polyester resin is dissolved in the organic solvent. The crystalline polyester resin may include a single compound or a mixture of at least two compounds. A use amount of the crystalline polyester resin may be determined considering viscosity and other properties. The organic solvent may include methyl ethyl ketone, isopropyl alcohol, ethyl acetate, or a combination of any two or more thereof.

Subsequently, an alkaline solution is slowly added while stirring a solution including the crystalline polyester resin, and water is added at a predetermined speed to form emulsion liquid. The alkaline solution is added to neutralize the solution including the crystalline polyester resin. The alkaline solution may include an ammonia aqueous solution, an amine compound aqueous solution, or a combination thereof. The alkaline solution may be a solution of a single compound or a mixture of solutions of two or more compounds. The addition amount of the alkaline solution may be appropriately determined by considering acidity of the solution including the crystalline polyester resin. The addition amount of the water may be appropriately determined by considering the particle diameter of the latex. The addition speed of the water may be appropriately determined by considering a particle diameter distribution of the latex.

Subsequently, the organic solvent is removed from the emulsion so that a concentration of the solid crystalline polyester resin may reach a predetermined concentration and the crystalline polyester resin latex is obtained. The removal of the organic solvent may be performed by a reduced pressure distillation method. In the crystalline polyester resin latex, the concentration of the crystalline polyester resin may be appropriately determined considering viscosity, storage stability, economy, and other properties. For example, the concentration of the crystalline polyester resin may be greater than or equal to about 10 wt % and less than or equal to about 50 wt %, for example, greater than or equal to about 20 wt % and less than or equal to about 40 wt %.

(2) Second Example

In the second example, the binder latex forming process includes an addition polymerization of the styrene component and the acryl-based component, an addition polymerization of only the styrene component, or an addition polymerization of only the acryl-based component, and is a process of forming the amorphous styrene acryl-based polymer latex while synthesizing the amorphous styrene acryl-based polymer.

Hereinafter, the addition polymerization of the styrene component and the acryl-based component is described. However, the addition polymerization of only styrene component or the addition polymerization of only acryl-based component may be applied in the same manner to synthesize the amorphous styrene acryl-based polymer.

In the present process, first, the styrene component and the acryl-based component are put in a reaction vessel. Subsequently, a mixture of the styrene component and the acryl-based component is dissolved to form a mixed solution including the styrene component and the acryl-based component. The styrene component may include styrene, parachlorostyrene, alpha-methylstyrene, or a combination of any two or more thereof as described above. The styrene component may be a single compound or a mixture of at least two compounds. The acryl-based component may include esters having a vinyl group, carboxylates or carboxylic acids having a double bond, olefins, or a combination of any two or more thereof as described above. The acryl-based component may be a single compound or a mixture of at least two compounds. An amount of the styrene component and an amount of the acryl-based component may be appropriately determined considering properties that the amorphous styrene acryl-based polymer needs.

Subsequently, an anionic surfactant and water are put in the reaction vessel, and a mixture of the styrene component, the acryl-based component, anionic surfactant, and water are dispersed to form an emulsion. The anionic surfactant and the water may be added individually or an aqueous solution of the anionic surfactant may be added. The anionic surfactant may include an alkylbenzene sulfonate salt.

Examples of the anionic surfactant may include an alkyldiphenyloxide disulfonate salt (DOWFAX 2A1 (trade name), Dow Chemical Co., Ltd.), an alkyldiphenylether sulfonate salt (DOWFAX C6L (trade name), Dow Chemical Co., Ltd.), linear sodium alkylbenzene sulfonate (LIPAL 870P, Lion Corporation), linear sodium alkylbenzene sulfonate (LAS (abbreviation), C10 to C15 linear alkyl group, Teika Corporation), and sodium α-olefin sulfonate (AOS (abbreviation), a mixture of C14 and C16, Lion Corporation). The anionic surfactant may include a single compound or a mixture of at least two compounds. Use amounts of the anionic surfactant and the water may be appropriately determined considering a dispersion state. The dispersion of the mixture may be performed using a homogenizer.

Subsequently, a polymerization initiator is added to the reaction vessel. After the inside of the reaction vessel is under an inert gas atmosphere, the styrene component and the acryl-based component is emulsion-polymerized at a predetermined temperature for a predetermined time to form the amorphous styrene acryl-based polymer and obtain the amorphous styrene acryl-based polymer latex. Examples of the polymerization initiator are not particularly limited and may be peroxides such as hydrogen peroxide, acetyl peroxide, cumyl peroxide, tert-butyl peroxide, propinonyl peroxide, benzoyl peroxide, chlorobenzoyl peroxide, dichlorobenzoyl peroxide, bromomethyl benzoyl peroxide, lauroyl peroxide, ammonium persulfate, sodium persulfate, potassium persulfate, diisopropyl peroxy carbonate, tetrahydroperoxide, 1-phenyl-2-methyl propyl-1-hydroperoxide, triphenyl peracetate, tert-butylhydroperoxide, tert-butyl performate, tert-butyl peracetate, tert-butyl perbenzoate, phenyl tert-butyl peracetate, methoxy tert-butyl peracetate, and N-(3-tolyl) tert-butyl carbamate; azo compounds such as 2,2'-azobispropane, 2,2'-dichloro-2,2'-azobispropane, 1,1'-azo(methyl ethyl)diacetate, 2,2'-azobis (2-amidino propane) hydrochloride, 2,2'-azobis (2-amidino propane)nitrate, 2,2'-azobisisobutane, 2,2'-azobisisobutylamide, 2,2'-azobisisobutyronitrile, methyl 2,2'-azobis-2-methyl propionate, 2,2'-dichloro-2,2'-azobisbutane, 2,2'-azobis-2-methylbutyronitrile, dimethyl 2,2'-azobisiso butyrate, 1,1'-azobis (sodium 1-methyl butyronitrile-3-sulfonate), 2-(4-methylphenylazo)-2-methylmalonodinitrile, 4,4'-azobis-4-cyanovaleric acid, 3,5-di(hydroxymethyl)phenylazo-2-methylmalonodinitrile, 2-(4-bromophenyl azo)-2-arylmalonodinitrile, 2,2'-azobis-2-methylvaleronitrile, 4,4'-azobis-4-cyano valeric acid dimethyl ester, 2,2'-azobis-2,4-dimethylvaleronitrile, 1,1'-azobiscyclohexanenitrile, 2,2'-azobis-2-propyl butyronitrile, 1,1'-azobis-1-chlorophenyl ethane, 1,1'-azobis-1-cyclohexane carbonitrile, 1,1'-azobis-1-cycloheptanenitrile, 1,1'-azobis-1-phenylethane, 1,1'-azobiscumene, 4-nitrophenylazobenzylcyanoethyl acetate, phenylazodiphenylmethane, phenylazotriphenylmethane, 4-nitro phenylazotriphenylmethane, 1,1'-azobis-1,2-diphenyl ethane, poly(bisphenolA-4,4'-azobis-4-cyanopentanoate), and poly(tetraethylene glycol-2,2'-azobisisobutyrate); 1,4-bis(pentaethylene)-2-tetrazene; and 1,4-dimethoxycarbonyl-1,4-diphenyl-2-tetrazene.

The polymerization initiator may be a single compound or a mixture of at least two compounds.

In the amorphous styrene acryl-based polymer latex, a concentration of the amorphous styrene acryl-based polymer may be appropriately determined considering stability, economy, and other factors. For example, the concentration of the amorphous styrene acryl-based polymer may be greater than or equal to about 10 wt % and less than or equal to about 50 wt %, for example, greater than or equal to about 20 wt % and less than or equal to about 45 wt %.

2. Phosphor Dispersion Forming Process

The present process is a process of forming dispersion of a phosphor. The phosphor dispersion forming process includes a phosphor forming process and a phosphor dispersion forming process.

<Formation Process of Phosphor>

The phosphor forming process is a process of forming a phosphor including either one or both of nitride and oxynitride each including the alkaline-earth metal and the silicon by obtaining a phosphor precursor particle from suspension liquid including a silicon nitride particle, an alkaline-earth metal-containing material, and activator element-containing material through a wet chemical method, and firing the obtained particles.

The phosphor forming process includes a precursor preparation process and a firing process.

(Preparation Process of Precursor)

As raw materials, a silicon nitride particle and a material including an alkaline-earth metal and a material including an activator element are used.

The silicon nitride particle as a raw material may be amorphous. When the amorphous silicon nitride particle is used as a raw material, a cation exchange of ions between a silicon ion and an alkaline-earth metal ion or activator element may easily occur between the silicon nitride particle and a compound including an alkaline-earth metal or a compound including an activator element deposited on a surface of the silicon nitride particle during firing. The silicon nitride particle as a raw material may have a volume average particle diameter of less than or equal to about 150 nm, for example less than or equal to about 120 nm. When the silicon nitride particle has a volume average particle diameter within the aforementioned ranges, a phosphor precursor particle having a small particle diameter is obtained, and as a result, a phosphor having a small particle diameter is obtained. When the silicon nitride particle has a volume average particle diameter within the aforementioned ranges, particle size distribution may be controlled and a phosphor with a narrow distribution of the particle diameters (e.g., most of the diameters of the particles are focused at or converged to a single value) may be obtained.

For the alkaline-earth metal-containing material as a raw material, examples of a Ca-containing material may include calcium oxide, calcium hydroxide, calcium carbonate, calcium nitrate 4 hydrate, calcium sulfate 4 hydrate, calcium oxalate 1 hydrate, calcium acetate 1 hydrate, calcium chloride, calcium fluoride, calcium nitride, calcium imine, calcium amide, and a combination of any two or more thereof. For example, the Ca-containing material may include calcium nitrate 4 hydrate, calcium chloride, or a combination thereof.

Examples of a Sr-containing material may include strontium oxide, strontium hydroxide 8 hydrate, strontium carbonate, strontium nitrate, strontium sulfate, strontium oxalate 1 hydrate, strontium acetate 0.5 hydrate, strontium chloride, strontium fluoride, strontium nitride, strontium imine, strontium amide, and a combination of any two or more thereof. For example, the Sr-containing material may include strontium nitrate, strontium chloride, or a combination thereof.

Examples of a Ba-containing material may include barium oxide, barium hydroxide 8 hydrate, barium carbonate, barium nitrate, barium sulfate, barium oxalate, barium acetate, barium chloride, barium fluoride, barium nitride, barium imine, barium amide, or a combination of any two or more thereof. For example, the Ba-containing material may include barium nitrate, barium chloride, or a combination thereof.

For the activator element-containing material as a raw material, examples of a Eu-containing material may include europium oxide, europium sulfate, europium oxalate 10 hydrate, europium(II) chloride, europium(III) chloride, europium(II) fluoride, europium(III) fluoride, europium nitrate 6 hydrate, europium nitride, europium imine, europium amide, or a combination of any two or more thereof. For example, the Eu-containing material may include europium nitrate 6 hydrate, europium oxide, europium(II) chloride, or a combination of any two or more thereof. For example, the activator element may include Ce, Mn, Pr, Nd, Sm, Tb, Dy, Ho, Er, Tm, Yb, or a combination of any two or more thereof in addition to Eu, and examples of a material including the activator element may include compounds where each Eu of the Eu-containing material is substituted with Ce, Mn, Pr, Nd, Sm, Tb, Dy, Ho, Er, Tm, Yb, or a combination of any two or more thereof.

In the precursor preparation process, prepared is a phosphor precursor particle including a silicon nitride particle, a compound including an alkaline-earth metal deposited on a surface of the silicon nitride particle, and a compound including an activator element deposited on the surface of the silicon nitride particle, and having a volume average particle diameter of less than or equal to about 250 nm, for example, less than or equal to about 210 nm.

For example, in order to obtain an $MSi_2O_2N_2$-based oxynitride (wherein M includes one or more alkaline-earth metal selected from Ca, Sr, and Ba and at least Sr and one or more activator element selected from Eu and Ce and at least Eu, and about 15 mol % or greater and about 99 mol % or less of Sr, for example, about 20 mol % or greater and about 95 mol % or less of Sr, and about 1 mol % or greater and about 20 mol % or less of the activator element, for example, about 5 mol % or greater and about 15 mol % or less of the activator element, based on a sum of the element M), in a precursor preparation process, prepared is a phosphor precursor particle including a silicon nitride particle, a compound including an alkaline-earth metal (including one or more alkaline-earth metal selected from Ca, Sr, and Ba and including at least Sr) deposited on a surface of the silicon nitride particle, and an activator element compound (including one or more activator element selected from Eu and Ce and including at least Eu) deposited on the surface of the silicon nitride particle, and having a volume average particle diameter of less than or equal to about 250 nm, for example, less than or equal to about 210 nm. The phosphor precursor particle includes the silicon nitride particle, the compound including an alkaline-earth metal, and the compound including an activator element so that a mole ratio of a sum of the alkaline-earth metal and the activator element, and silicon may range from about 1:1.4 to about 1:2.86, for example, from about 1:1.5 to about 1:2.67. In addition, the phosphor precursor particle includes about 15 mol % or greater and about 99 mol % or less of Sr, for example, about 20 mol % or greater and about 95 mol % or less of Sr, and about 1 mol % or greater and about 20 mol % or less of the activator element, for example, about 5 mol % or greater and about 15 mol % or less of the activator element, based on a sum of the alkaline-earth metal and the activator element.

The precursor preparation process includes a suspension liquid forming process and a precursor forming process.

[Formation Process of Suspension]

In order to obtain the nitride or oxynitride containing an alkaline-earth metal and silicon in a desired composition, prepared is a suspension including a silicon nitride particle, an alkaline-earth metal-containing material, and an activator element-containing material as a raw material in a predetermined ratio.

For example, in order to obtain the aforementioned $MSi_2O_2N_2$-based oxynitride, the suspension including the silicon nitride particle, the alkaline-earth metal-containing material, and the activator element-containing material within a mole ratio ranging from about 1:1.4 to about 1:2.86, for example, about 1:1.5 to about 1:2.67, between a sum of an alkaline-earth metal and an activator element and silicon is prepared. When the mole ratio is out of the range, a yield of a phosphor may be decreased, but its producing cost may be increased.

The suspension has the Sr in an amount of greater than or equal to about 15 mol % and less than or equal to about 99 mol %, for example, greater than or equal to about 20 mol % and less than or equal to about 95 mol %, and the activator element in an amount of greater than or equal to about 1 mol % and less than or equal to about 20 mol %, for example, greater than or equal to about 5 mol % and less than or equal to about 15 mol %, based on a sum of the element M.

The suspension may be prepared by putting the raw materials in a solvent and stirring the same.

Examples of the solvent for the suspension may include water; and a mixed solvent of water and at least one polyhydric alcohol selected from ethylene glycol, propylene glycol, tetramethylene glycol, heptamethylene glycol, hexamethylene glycol, glycerine, and sorbitol.

[Formation Process of Precursor]

The suspension is treated in a wet chemical method to obtain phosphor precursor particles having a volume average particle diameter of less than or equal to about 250 nm, for example, less than or equal to about 210 nm, wherein the compound including an alkaline-earth metal and the compound including an activator element are mixed and deposited on the surface of the silicon nitride particles.

For example, the aforementioned $MSi_2O_2N_2$-based oxynitride may be obtained by applying the wet chemical method to the suspension to precipitate the compound including an alkaline-earth metal and the compound including an activator element on the surface of the silicon nitride particles, so that the compound including an alkaline-earth metal and the compound including an activator element are mixed and deposited thereon, and resultantly, to obtain the phosphor precursor particles having a volume average particle diameter of less than or equal to about 250 nm, for example, less than or equal to about 210 nm.

The phosphor precursor particles may include the silicon nitride particles, the compound including an alkaline-earth metal, and the compound including an activator element in a mole ratio ranging from about 1:1.4 to about 1:2.86, for example, from about 1:1.5 to about 1:2.67, between a sum of the alkaline-earth metal and the activator element and silicon.

When the mole ratio is out of the aforementioned range, a yield of the phosphor may decrease and the production cost may increase.

The phosphor precursor particle includes the Sr in an amount of about 15 mol % or greater and about 99 mol % or less, for example, about 20 mol % or greater and about 95 mol % or less, and the activator element in an amount of about 1 mol % or greater and about 20 mol % or less, for example, about 5 mol % or greater and about 15 mol % or less, based on the sum of the element M. When the phosphor precursor particles have a volume average particle diameter of less than or equal to about 250 nm, a phosphor having a small particle diameter may be obtained. When the phosphor precursor particles have a volume average particle diameter of less than or equal to about 250 nm, a particle size distribution may be controlled, and a phosphor having a particle diameter converging to a predetermined value may be obtained.

When the wet chemical method is applied to the suspension, the compound including an alkaline-earth metal and the compound including an activator element are mixed with each other and simultaneously deposited on the surface of the silicon nitride particles. Accordingly, exchange of cations between the ions of the alkaline earth metal or the activator element and the silicon ion may be easily made. Resultantly, nitride (or oxynitride) having a desired composition may be synthesized during the short period of time for a particle growth. The wet chemical method may be any method of mixing and depositing the compound including an alkaline-earth metal and the compound including an activator element on the surface of the silicon nitride particle. For example, the wet chemical method may be a co-precipitation method, a citrate method, or a combination thereof. For example, either the co-precipitation method or the citrate method may be used as the wet chemical method. For example, both the co-precipitation method and the citrate method may be used as the wet chemical method. When the co-precipitation method and/or the citrate method is used, the compound including an alkaline-earth metal or the compound including an activator element may be easily precipitated on the surface of the silicon nitride particles and also, easily capture and contact the silicon nitride particles. Accordingly, a cation exchange between the alkaline earth metal ion or the activator element ion and the silicon ion may be easily carried out during the firing. Accordingly, nitride (or oxynitride) having a desired composition may be synthesized during the short particle growth.

The co-precipitation method may be performed by adding a co-precipitator to the suspension. The co-precipitator may include an ammonium hydrogen carbonate aqueous solution, an ammonium carbonate aqueous solution, a urea aqueous solution, an acetamide aqueous solution, a thiourea aqueous solution, a thioacetamide aqueous solution, or a combination of any two or more thereof. For example, the co-precipitator may include an ammonium hydrogen carbonate aqueous solution, an ammonium carbonate aqueous solution, or a combination thereof.

The citrate method may be performed by adding citric acid to the suspension.

The compound including an alkaline-earth metal or the compound including an activator element that is deposited on a surface of the silicon nitride particle may include at least one compound selected from a carbonate salt, a hydrogen carbonate salt, a phosphate salt, carboxylate salt, an oxalate salt, a sulfate salt, an organic metallic compound, and a hydroxide. For example, the compound including an alkaline-earth metal or the compound including an activator element may include at least one compound selected from a carbonate salt and a hydroxide. The carbonate salt or the hydroxide may be easily precipitated by a co-precipitation method or a citrate method. The phosphor precursor particle in the suspension may be, for example, collected by centrifugation.

(Firing Process)

The obtained phosphor precursor particles are fired. The firing is performed under a condition such that a phosphor including a nitride or an oxynitride including an alkaline-earth metal, silicon, and an activator element in a desired composition may have a small particle diameter and exhibit desired light emitting characteristics.

For example, in order to obtain the aforementioned $MSi_2O_2N_2$-based oxynitride, the obtained phosphor precursor particles are fired under a mixed gas atmosphere of hydrogen and nitrogen or a mixed gas atmosphere of ammonia and nitrogen at greater than or equal to about 1150° C. and less than or equal to about 1650° C., for example, at greater than or equal to about 1200° C. and less than or equal to about 1600° C. The firing under the mixed gas atmosphere of hydrogen and nitrogen or the mixed gas atmosphere of ammonia and nitrogen may provide a phosphor including the $MSi_2O_2N_2$-based oxynitride as a main component. The phosphor including the $MSi_2O_2N_2$-based oxynitride as a main component may have desirable light emitting characteristics. In addition, the firing at greater than or equal to about 1150° C. may prevent insufficient firing of the $MSi_2O_2N_2$-based oxynitride and production of impurities other than the $MSi_2O_2N_2$-based oxynitride and thus provide the phosphor having excellent light emitting characteristics. Furthermore, the firing at less than or equal to about 1650° C. may prevent excessive growth of particles and fusing of the $MSi_2O_2N_2$-based oxynitride. Since the excessive growth of the particle is prevented, the phosphor having a small particle diameter may be obtained, and since the $MSi_2O_2N_2$-based oxynitride is prevented from melting, the phosphor including the $MSi_2O_2N_2$-based oxynitride may be easily obtained.

The firing may be performed, for example, in the following order. First, the obtained phosphor precursor particles are charged in a container made of a heat-resistant material having a low reactivity. The heat-resistant container may be, for example, a crucible or a tray. The material for the heat resistant container may be, for example, a ceramic such as alumina, boron nitride, silicon nitride, silicon carbide, magnesium, mullite, or other ceramics, a metal such as platinum, molybdenum, tungsten, tantalum, niobium, iridium, rhodium, or other metals, an alloy including these metals as a main component, carbon (graphite), or a combination of any two or more thereof. For example, the material for the heat resistant container may be boron nitride, alumina, silicon nitride, silicon carbide, platinum, molybdenum, tungsten, tantalum, or a combination of any two or more thereof.

Subsequently, the heat resistant container charged with the phosphor precursor particles is placed in a firing device. The firing device may be, for example, a metal furnace or a carbon furnace.

Subsequently, the pressure in the firing device in which the heat resistant container is placed is reduced to substantially a vacuum. Subsequently, a temperature inside the firing device may be increased up to a firing/calcinations temperature. In order to obtain a phosphor including nitride (or oxynitride) having a desired composition and thus having a small particle diameter and improved light emitting characteristics, a predetermined gas is introduced into the firing device to restore the pressure in the firing device to substantially an atmospheric pressure. For example, in order to obtain the aforementioned $MSi_2O_2N_2$-based oxynitride, a mixed gas of hydrogen and nitrogen or a mixed gas of ammonia and nitrogen may be introduced into the firing device. Subsequently, the temperature of the firing device is increased up to a predetermined firing temperature and maintained for a predetermined time to obtain the phosphor including a nitride (or an oxynitride) having a desired composition and thus having a small particle diameter and improved light emitting characteristics. For example, in order to obtain the $MSi_2O_2N_2$-based oxynitride, the firing temperature may be in a range of greater than or equal to about 1150° C. and less than or equal to about 1650° C., for example, greater than or equal to about 1200° C. and less than or equal to about 1600° C.

<Formation Process of Phosphor Dispersion>

The present process is a process of forming dispersion of the phosphor.

In the present process, first, the phosphor, an anionic surfactant, water, and a dispersion media are put in a reaction vessel. The phosphor may include a single type phosphor or at least two types of the phosphor. A used amount of the phosphor may be appropriately determined considering a dispersion state. Examples of the anionic surfactant may include an alkylbenzenesulfonate salt. For example, the anionic surfactant may include an alkyldiphenyloxide disulfonate salt (DOWFAX 2A1, Dow Chemical Co., Ltd.), an alkyldiphenylether sulfonate salt (DOWFAX C6L, Dow Chemical Co., Ltd.), linear sodium alkylbenzene sulfonate (LIPAL 870P, Lion Corporation), linear sodium alkylbenzene sulfonate (LAS (abbreviation), C10 to C15 linear alkyl group, Teika Corporation), sodium α-olefin sulfonate (AOS (abbreviation), a mixture of C14 and C16, Lion Corporation). The anionic surfactant may include a single compound or a mixture of at least two compounds. A use amount of the anionic surfactant may be appropriately determined considering a dispersion state.

A use amount of the water may be appropriately determined by considering the particle diameter of the latex.

Examples of the dispersion media may include zirconia $ZrO_2$ beads. A use amount of the dispersion media may be appropriately determined by considering a dispersion state, a dispersion time, and other variables.

Subsequently, the mixture of the phosphor, the anionic surfactant, the water, and the dispersion media may be dispersed to obtain a phosphor dispersion. The dispersion of the mixture may be performed using a bead mill, a milling bath, an ultrasonic wave disperser, or a microfluidizer. A concentration of the phosphor in the phosphor dispersion may be appropriately determined by considering storage stability, economy, and other factors. For example, the concentration of the phosphor may be greater than or equal to about 1 wt % and less than or equal to about 30 wt %, for example, greater than or equal to about 5 wt % and less than or equal to about 20 wt %.

3. Formation Process of Non-Fluorescent Colorant Dispersion

The present process is to form a non-fluorescent colorant dispersion. First, a non-fluorescent colorant such as a pigment or a dye, an anionic surfactant, and a dispersion medium are put in a reaction vessel. A toner for developing electrostatic images of an example may use the non-fluorescent colorant including any known pigment or dye as described above. The non-fluorescent colorant may be one type or more than one type. A used amount of the non-fluorescent colorant may be appropriately determined considering a dispersion state. Examples of the anionic surfactant may include an alkylbenzene sulfonate salt. For example, the anionic surfactant may include an alkyldiphenyloxide disulfonate salt (DOWFAX 2A1, Dow Chemical Co., Ltd.), an alkyldiphenylether sulfonate salt (DOWFAX C6L, Dow Chemical Co., Ltd.), linear sodium alkylbenzene sulfonate (LIPAL 870P, Lion Corporation), linear sodium alkylbenzene sulfonate (LAS (abbreviation), C10 to C15 linear alkyl group, Teika Corporation), sodium α-olefin sulfonate (AOS (abbreviation), a mixture of C14 and C16, Lion Corporation). The anionic surfactant may include a single compound or a mixture of at least two compounds. A used amount of the anionic surfactant may be appropriately selected considering a dispersion state. Examples of the dispersion media may include glass beads. A used amount of the dispersion media may be appropriately selected by considering a dispersion state, a dispersion time, and other variables.

Subsequently, the mixture of the non-fluorescent colorant, the anionic surfactant, and the dispersion medium are dispersed to obtain the non-fluorescent colorant dispersion. The dispersion of the mixture may be performed using a bead mill, a milling bath, an ultrasonic wave disperser, or a microfluidizer. A concentration of the non-fluorescent colorant in the non-phosphor colorant dispersion may be appropriately determined by considering storage stability, economy, and other factors. For example, the concentration of the non-fluorescent colorant may be greater than or equal to about 3 wt % and less than or equal to about 50 wt %, for example, greater than or equal to about 10 wt % and less than or equal to about 30 wt %.

4. Formation Process of Release Agent Dispersion

In case of preparing a toner including a release agent, a process for forming a release agent dispersion is carried out. The present process is to form a dispersion including a release agent.

First, a release agent, an anionic surfactant, and water are put in a reaction vessel. In a toner for developing electrostatic images of an example, a release agent such as solid paraffin wax, microcrystalline wax, rice wax, fatty acid amide-based wax, fatty acid-based wax, aliphatic mono ketones, fatty acid metal salt-based wax, fatty acid ester-based wax, partially saponified fatty acid ester-based wax, silicon varnish, higher alcohols, Carnauba wax, for example, may be used as described above. The release agent may include a single type one or at least two types thereof. A used amount of the release agent may be appropriately selected considering a dispersion state. Examples of the anionic surfactant may include an alkylbenzenesulfonate salt. For example, the anionic surfactant may include an alkyldiphenyloxide disulfonate salt (DOWFAX 2A1 (trade name), Dow Chemical Co., Ltd.), an alkyldiphenylether sulfonate salt (DOWFAX C6L (trade name), Dow Chemical Co., Ltd.), linear sodium alkylbenzene sulfonate (LIPAL 870P (trade name), Lion Corporation), linear sodium alkylbenzene sulfonate (LAS (abbreviation), C10 to C15 linear alkyl group, Teika Corporation), sodium α-olefin sulfonate (AOS (abbreviation), a mixture of C14 and C16, Lion Corporation). The anionic surfactant may include a single compound or a mixture of at least two compounds. A used amount of the anionic surfactant may be appropriately selected considering a dispersion state. A used amount of the water may be appropriately determined by considering a dispersion state, storage stability, economy, and other factors.

Subsequently, the mixture of the release agent, the anionic surfactant and water is dispersed to obtain a release agent dispersion. The dispersion may be performed using a homogenizer.

5. Formation Process of Mixed Solution

Herein, a binder latex, a phosphor dispersion, a non-fluorescent colorant dispersion, and a release agent dispersion (optionally, to prepare a toner including a release agent) are mixed to obtain a mixed solution. Hereinafter, each mixing process for a first example binder using a mixture of an amorphous polyester-based resin and a crystalline polyester resin and a second example binder using the amorphous styrene acryl-based polymer as the binder is described.

First Example Binder

First, an amorphous polyester-based resin latex, a crystalline polyester resin latex, the phosphor dispersion, a non-fluorescent colorant dispersion, a release agent dispersion (optionally to prepare a toner including a release agent), an anionic surfactant, and water are charged in a reaction vessel.

Subsequently, the obtained mixture is stirred to form a mixed solution including the amorphous polyester-based resin latex, the crystalline polyester resin latex, the phosphor dispersion, the non-fluorescent colorant dispersion, optionally the release agent dispersion in case of a toner including a release agent, the anionic surfactant, and the water. The amounts of the amorphous polyester-based resin latex and the crystalline polyester resin latex may be appropriately selected considering properties of the toner. The amounts of the phosphor dispersion and the non-fluorescent colorant dispersion may be appropriately selected considering a coloring property of the toner. The amount of the release agent dispersion may be appropriately selected considering properties of the toner. Examples of the anionic surfactant may include an alkylbenzene sulfonate salt. The anionic surfactant may include an alkyldiphenyloxide disulfonate salt (DOWFAX 2A1 (trade name), Dow Chemical Co., Ltd.), an alkyldiphenylether sulfonate salt (DOWFAX C6L (trade name), Dow Chemical Co., Ltd.), linear sodium alkylbenzene sulfonate (LIPAL 870P (trade name), Lion Corporation), linear sodium alkylbenzene sulfonate (LAS (abbreviation), C10 to C15 linear alkyl group, Teika Corporation), sodium α-olefin sulfonate (AOS (abbreviation), a mixture of C14 and C16, Lion Corporation). The anionic surfactant may include a single compound or a mixture of at least two compounds. An addition amount of the anionic surfactant may be appropriately selected considering a dispersion state. An addition amount of the water may be appropriately selected considering viscosity of the mixture, economy, and other factors.

(2) Second Example Binder

First, an amorphous styrene acryl-based polymer latex, a phosphor dispersion, a non-fluorescent colorant dispersion, a release agent dispersion (optionally to prepare a toner including a release agent), an anionic surfactant and water are put in a reaction vessel.

The mixture is stirred to prepare a mixed solution including the amorphous styrene acryl-based polymer latex, the phosphor dispersion, the non-fluorescent colorant dispersion, the release agent dispersion (optionally to prepare a toner including the release agent), the anionic surfactant, and the water. An addition amount of the amorphous styrene acryl-based polymer latex may be appropriately selected considering properties of the toner. Addition amounts of the phosphor dispersion and the non-fluorescent colorant dispersion may be appropriately selected considering a coloring property of the toner. An addition amount of the release agent dispersion may be appropriately selected considering properties of the toner. Examples of the anionic surfactant may include an alkylbenzenesulfonate salt. For example, the anionic surfactant may include an alkyldiphenyloxide disulfonate salt (DOWFAX 2A1, Dow Chemical Co., Ltd.), an alkyldiphenylether sulfonate salt (DOWFAX C6L, Dow Chemical Co., Ltd.), linear sodium alkylbenzene sulfonate (LIPAL 870P, Lion Corporation), linear sodium alkylbenzene sulfonate (LAS (abbreviation), C10 to C15 linear alkyl group, Teika Corporation), sodium α-olefin sulfonate (AOS (abbreviation), a mixture of C14 and C16, Lion Corporation), or a combination of any two or more thereof. The anionic surfactant may include a single compound or a mixture of at least two compounds. An amount of the water may be appropriately selected considering viscosity of the mixture, economy, and other factors.

6. Formation Process of Primary Agglomeration Particles

An agglomerating agent is added to the mixed solution to agglomerate the binder, the phosphor, the non-fluorescent colorant, and the release agent (optionally to prepare a toner including the release agent) and to form primary agglomeration particles.

First, in order to prepare the toner including the binder latex, the phosphor dispersion, the non-fluorescent colorant dispersion, and the release agent, the agglomerating agent is added to the mixed solution including the release agent dispersion, the anionic surfactant, and the water while the mixed solution is stirred.

A first example binder latex includes an amorphous polyester-based resin latex and a crystalline polyester resin latex, and a second example binder latex includes the amorphous styrene acryl-based polymer latex.

The agglomerating agent may include an iron element and a silicon element. For example, the agglomerating agent may include an iron-based metal salt. For example, the agglomerating agent may include polysilicate-iron. An addition amount of the agglomerating agent may be appropriately determined by considering the content range of each of the iron element and the sulfur element. For example, an addition amount of the agglomerating agent may be in a range of greater than or equal to about 0.15 wt % and less than or equal to about 1.5 wt %, for example, greater than or equal to about 0.3 wt % and less than or equal to about 1.0 wt %, based on a total weight of the agglomerating agent, the binder, the phosphor, the non-fluorescent colorant, and the release agent (if present). When the agglomerating agent is added within the above range, the contents of the iron element and the sulfur element may be within the aforementioned ranges. When the agglomerating agent is added in an amount of greater than about 1.5 wt %, a minimum fusing temperature (MFT) of a toner may be excessively increased. When the agglomerating agent is added in an amount of less than about 0.15 wt %, agglomeration may be deteriorated, and toner particles are difficult to form.

Subsequently, the solution to which the agglomerating agent is added is heated up to a predetermined temperature at a predetermined temperature increase speed and maintained at the predetermined temperature for a predetermined time during the dispersion. Herein, the binder, the phosphor, the pigment, and the release agent (if present) are agglomerated and form primary agglomeration particles having a predetermined size to prepare primary agglomeration particle dispersion. The primary agglomeration particles may have a volume average particle diameter adjusted by controlling an agitation speed or a temperature increase speed, agglomeration time, and other variables during the dispersion. The volume average particle diameter of the primary agglomeration particles may be appropriately determined by considering a particle diameter of the toner. For example, the primary agglomeration particles may have a volume average particle diameter of greater than or equal to about 2.5 μm and less than or equal to about 8.5 μm, for example, greater than or equal to about 3.0 μm and less than or equal to about 4.5 μm. After adding the agglomerating agent, the temperature increase rate of the solution, its maintenance/duration temperature and its maintenance/duration time after the increase of the temperature may be appropriately selected by considering a size and other properties of the primary agglomeration particles. The dispersion of the solution to which the agglomerating agent is added may be performed using a homogenizer.

7. Formation Process of Coated Agglomeration Particle

A coating layer formed of the binder is disposed on a surface of the primary agglomeration particles to prepare a coated agglomeration particle.

First, a binder latex is added to a primary agglomeration particle dispersion to agglomerate the primary agglomeration particles with a binder for a predetermined time, forming a coating layer with the binder on surface of the primary agglomeration particles, and thus obtaining a coated agglomeration particle dispersion.

In the first example, the amorphous polyester-based resin latex is used as the binder latex, and in the second example, the amorphous styrene acryl-based polymer latex is used as the binder latex.

An addition amount of the amorphous polyester-based resin latex may be appropriately selected considering properties of the toner.

The agglomeration time may be appropriately selected considering a particle diameter of the toner.

In the formation process of the coated agglomeration particles, an alkaline solution is subsequently added to the coated agglomeration particle dispersion to adjust pH, and then, the agglomeration is stopped.

Examples of the alkaline solution may include a sodium hydroxide aqueous solution, a potassium hydroxide aqueous solution, or a combination thereof. An addition amount of the alkaline solution may be appropriately selected by considering acidity of the coated agglomeration particle dispersion.

8. Fusion and Unification Process

A fusion and unification process is to fuse and unite the coated agglomeration particle.

After the agglomeration, the coated agglomeration particle dispersion is maintained at a higher temperature than a glass transition temperature of the amorphous binder for a predetermined time to fuse and unite the particles in the coated agglomeration particle. Accordingly, a toner particle having a coating layer on the surface and having a predetermined volume average particle diameter is formed, and a toner particle dispersion including the toner particles may be obtained. As for the first example, the fusion and unification process is performed at a higher temperature than a glass transition temperature of the amorphous polyester-based resin, and as for the second example, the fusion and unification process is performed at a higher temperature than a glass transition temperature of the amorphous styrene acryl-based polymer. A temperature and time for the fusion and unification process may be appropriately selected by considering properties, shape, economics, and the other properties of a toner. After the fusion and unification process, the toner particles are separated from the toner particle dispersion. The separation of the toner particles from the toner particle dispersion may be by filtering or other separation processes.

The obtained toner particles have the following characteristics (A) to (I).

(A) The toner particles include iron, silicon, and sulfur.

(B) An amount of the iron is greater than or equal to about $1.0\times10^3$ ppm and less than or equal to about $1.0\times10^4$ ppm, an amount of the silicon is greater than or equal to about $1.0\times10^3$ ppm and less than or equal to about $5.0\times10^4$ ppm, and an amount of the sulfur is greater than or equal to about 500 ppm and less than or equal to about 3000 ppm.

(C) A thickness of the coating layer is greater than or equal to about 0.2 μm and less than or equal to about 1.0 μm.

(D) A volume average particle diameter is greater than or equal to about 3 μm and less than or equal to about 9 μm.

(E) A coefficient of variation of a particle diameter is greater than or equal to about 15% and less than or equal to about 25%.

(F) A weight average molecular weight is greater than or equal to about 7000 and less than or equal to about 15000.

(G) A ratio of a weight average molecular weight to a number average molecular weight is greater than or equal to about 7.0 and less than or equal to about 17.0.

(H) A glass transition temperature is greater than or equal to about 50° C. and less than or equal to about 70° C.

(I) An acid value is greater than or equal to about 5 mg KOH/g and less than or equal to about 25 mg KOH/g.

C. Effect

According to a toner for developing electrostatic images of an example, a phosphor having a small particle diameter and excellent light emitting characteristics is used along with a non-fluorescent colorant as a colorant. The toner for developing electrostatic images may show an improved color reproduction range.

According to the method of producing the toner for developing electrostatic images of an example, the phosphor having a small particle diameter and excellent light emitting characteristics may be used along with the non-fluorescent colorant as a colorant when a binder is agglomerated with the colorant. Accordingly, the toner for developing electrostatic images may show various improved color reproduction ranges.

Hereinafter, specific examples are described. However, the following examples are only provided to specifically describe or explain this disclosure, but do not limit the scope of the disclosure.

Example

First, measurement and/or evaluation methods are explained.

<Glass Transition Temperature of Amorphous Polyester-Based Resin, Amorphous Styrene Acryl-Based Resin, and Toner> and <Melting Point of Crystalline Polyester Resin>

A glass transition temperature (° C.) and a melting point (° C.) are obtained from a differential scanning calorimetry (DSC) curve through a differential scanning calorimetry (DSC) measurement according to ASTM D3418-08.

The differential scanning calorimetry (DSC) curve is obtained using a differential scanning calorimeter Q2000 (TA Instruments) and increasing a temperature from room temperature to 150° C. at 10° C./min as a first temperature increase process, maintaining the temperature at 150° C. for 5 minutes, and then decreasing the temperature down to 0° C. at 10° C./min using liquid nitrogen. Then, the temperature is maintained at 0° C. for 5 minutes and increased from 0° C. to 150° C. at 10° C./min as a second temperature increase process, and the glass transition temperature and the melting point are obtained from the differential scanning calorimetry (DSC) curve.

<Weight Average Molecular Weight of Amorphous Polyester-Based Resin, Crystalline Polyester Resin, Amorphous Styrene Acryl-Based Resin, and Toner> and <Ratio of Weight Average Molecular Weight to Number Average Molecular Weight of Toner>

A weight average molecular weight and the number average molecular weight are obtained through a gel permeation chromatography (GPC) measurement. A Waters e2695 Separations Module (manufactured by Waters Co., Ltd., Japan) is used as a measuring device, and Inertsil CN-3 25 cm 2 series (manufactured by GL Sciences, Inc.) is used for a column.

In addition, 30 mg of a measurement object is put in 20 mL of tetrahydrofuran (THF) (containing a stabilizer, Wako Pure Chemical Industries, Ltd., Japan), the mixture is stirred for one hour and filtered through a 0.2 μm filter, the filtered solution is used as a specimen. 20 μL of the tetrahydrofuran (THF) specimen solution is injected into a measuring device, and the measurements are performed under a condition of 40° C. at a rate of 1.0 mL/min. The obtained weight average molecular weight and number average molecular weight are used to calculate a ratio of the weight average molecular weight to the number average molecular weight.

<Volume Average Particle Diameter of Phosphor>

A volume average particle diameter is measured using a Dynamic Light Scattering (DLS) method. Specifically, ELS-Z1000ZS (Otsuka Electronics Co., Ltd.) is used to measure a particle size distribution. As for the measurement, the specimen is dispersed in ethanol or water with an ultrasonic wave for greater than or equal to 30 seconds to prepare a sample. Based on the measured particle size distribution, a particle diameter at a cumulative 50% by measuring a volume of particles included in each partitioned diameter range and accumulating their volumes from the small particle size is obtained as a volume average particle diameter Dv50.

<Light Emitting Peak Wavelength of Phosphor>

A light emitting peak wavelength is determined by measuring a fluorescence spectrum. Specifically, the fluorescence spectrum is measured using a F-7000 fluorescence spectrophotometer (Hitachi High-Technologies Corp.).

<Internal Quantum Efficiency of Phosphor>

Internal quantum efficiency is measured using a photoluminescence (PL) method.

Specifically, the internal quantum efficiency is measured using an absolute PL quantum yield spectrometer (Hamamatsu Photonics K.K.). As for the measurement, 0.1 g of a specimen is used. The measurement is performed at an excitation wavelength of 450 nm.

<Metal Element Analysis of Phosphor>

A metal element analysis is performed using ICP-MS (Agilent Technologies) and ICP-AES (Shimadzu Corp.). As for the metal element analysis, a specimen is alkali-dissolved using a flux (borax:sodium carbonate=1:1), and hydrochloric acid is added thereto to prepare a predetermined volume of a sample. A europium analysis is performed using ICP-MS (Agilent Technologies), and the other metal element analyses are performed using ICP-AES (Shimadzu Corp.).

<Powder X-Ray Diffraction of Phosphor>

A powder X-ray diffraction is performed using a SmartLab X-ray diffractometer (Rigaku Corp.). Specifically, CuKα is used as a ray source in the powder X-ray diffraction. An X-ray diffraction spectrum obtained through the powder X-ray diffraction is interpreted to perform qualitative and quantitative analyses of an inorganic compound formed in a specimen.

<Element Content of Toner>

Each content of an iron element, a silicon element, and a sulfur element is obtained through a fluorescent X ray analysis. Specifically, a fluorescent X ray analyzer EDX-720 (Shimadzu Corp.) is used under a condition of setting a voltage of an X-ray tube at 50 kV and forming 30.0 g of a sample. A quantitative result obtained from the fluorescent X ray analysis is as strength (cps/μA) to obtain each content of the elements.

<Received Amount of Phosphor into Toner>

The amount of the phosphor received into the toner with respect to the added amount of the phosphor as a raw material is calculated using a fluorescent X ray analysis method. Specifically, the fluorescent X ray analysis is performed by forming 2 g of a toner with a compress molder (Power Sample Hydraulic Press BRW-32, Maekawa Testing Machine Mfg. Co., Ltd.) under a pressure of 10 MPa for 10 seconds and using a pellet formed of the toner with an energy dispersive fluorescent X ray analyzer EDXL300 (Rigaku Corp.). The measurement results are used to calculate a Sr element ratio, which is then used to calculate a ratio of a received amount of the phosphor.

<Volume Average Particle Diameter of Toner>, <Coefficient of Variation of Particle Diameter of Toner>, <Volume Average Particle Size Distribution Index of Toner>, and <Amount of Particles Having Diameter of Less than or Equal to 3 μm of Toner>

A volume average particle diameter is measured using a pore electrical resistance method. Specifically, the volume average particle diameter is measured using a Coulter counter Beckman Coulter Inc.) as a measuring device, ISOTON II (Beckman Coulter Inc.) as an electrolyte solution, an aperture tube having a diameter of 100 μm, and 30000 particles. Based on the obtained particle size distribution of the particles, a particle diameter at cumulative 16% is regarded as Dv16, a particle diameter at cumulative 50% is regarded as Dv50, and a particle diameter at cumulative 84% is regarded as Dv84 by accumulating a volume of particles in partitioned diameter ranges from a smaller diameter to a larger diameter. Herein, Dv50 is defined as the volume average particle diameter, and a ratio of Dv84/Dv16 is defined as a volume average particle size distribution index GSDv. In addition, based on the obtained particle size distribution, a coefficient of variation of a particle diameter is calculated. The coefficient of variation of a particle diameter in % may be determined according to the following equation:

coefficient of variation of particle diameter (%)=standard deviation of diameter/average diameter×100

Based on the obtained particle size distribution, the number % of particles having a particle diameter of less than or equal to 3 μm is obtained as a presence amount of the particles having a particle diameter of less than or equal to 3 μm.

<Acid Value of Toner>

An acid value (mg KOH/g) is obtained according to a neutralization titration method described in Japanese Industrial Standard JIS K 0070:1992, "Test methods for acid value, saponification value, ester value, iodine value, and hydroxyl value and unsaponifiable matter of chemical products."

<Evaluation of Electric Charge Properties>

28.5 g of a magnetic substance carrier (SY129 made by KDK) and 1.5 g of a toner are put in a 60 ml glass container. Subsequently, the mixture is stirred with a Turbula mixer at 23° C. under relative humidity of 55% (an ambient temperature and an ambient humidity). An electric charge quantity of the toner is measured using an electric field separation method by every predetermined stirring time. A measurement at 10 minutes of the stirring time is regarded as the electric charge quantity of the toner.

<Volume Average Particle Diameter of Particles in Amorphous Polyester-Based Resin Latex and Crystalline Polyester Resin Latex> and <Volume Average Particle Size Distribution Index of Particles in Amorphous Polyester-Based Resin Latex and Crystalline Polyester Resin Latex>

A volume average particle diameter is measured using a Dynamic Light Scattering (DLS) method. Specifically, a nano track particle diameter distribution-measuring device (Nikkiso Co., Ltd.) is used as a measuring device. Based on the obtained particle size distribution of the particles, a particle diameter at cumulative 16% is regarded as Dv16, a particle diameter at cumulative 50% is regarded as Dv50, and a particle diameter at cumulative 84% is regarded as Dv84 by accumulating a volume occupied by the particles in partitioned diameter ranges from the small diameter to the large diameter.

Herein, Dv50 is defined as the volume average particle diameter, and a ratio of Dv84/Dv16 is defined as the volume average particle size distribution index GSDv.

<Fusing Property Evaluation>

A belt-type fixer (Color laser 660, Samsung Electronics Co., Ltd.) is used to fix a 100% solid patterned non-fixed image for a test on 60 g of a test paper (X-9, Boise White Paper, L.L.C) at a rate of 160 mm/sec for 0.08 seconds.

The non-fixed image for a test is fixed at a temperature ranging from 100° C. to 180° C. An initial optical density (OD) of the fixed image is measured. Subsequently, a 3M 810 tape is attached around the image and then, removed after five times reciprocating 500 g of a weight.

After removing the tape, optical density (OD) after the removal is measured. The lowest temperature at which greater than or equal to 90% of a fusing property is obtained according to the following equation is regarded as a minimum fusing temperature (MFT, ° C.):

Fusing property (%)=(optical density after removing tape/initial optical density)×100

<Image Evaluation>

The belt-type fixer (Color laser 660, Samsung Electronics Co., Ltd.) is used to fix a 100% solid patterned non-fixed image for a test on 60 g of a test paper (X-9, Boise White Paper, L.L.C) at a rate of 160 mm/sec for 0.08 seconds. The non-fixed image for a test is fixed at 150° C. Colorimetry and concentration of the fixed image are measured using a spectrophotometer.

In this experiment, a color value (L*a*b*) and an image concentration are measured using SpectroEye (X-Rite, Inc.) under a condition described in JSC2011, "Japan Color 2011 for Sheet-fed Offset based on ISO 12647-2" (Light source: D50, Viewing angle: 2°, Concentration: Status T).

Hereinafter, an amorphous polyester-based resin of Preparation Example 1 used in Examples and Comparative Examples is explained.

Preparation Example 1

(Esterification Process)

100 g of a 2 mole adduct of propylene oxide to bisphenol A, (Adeka Polyether PX-11, Adeka Corp.), 34.74 g of maleic anhydride (MA (abbreviation), Adeka Corp.), and 0.98 g of paratoluenesulfonic acid 1 hydrate (PTSA (abbreviation), Wako Pure Chemical Industries, Ltd.) are put in a 500 ml separable flask. After nitrogen is introduced into the flask, the mixture is heated for dissolution at 70° C. with stirring with an agitator. Subsequently, the mixed solution in the flask is heated up to 97° C., with stirring.

Subsequently, the pressure in the flask is reduced to substantially a vacuum (less than or equal to 10 mPa·s), and a dehydration condensation reaction is performed between a 2 mole adduct of propylene oxide to bisphenol A and the maleic anhydride at 97° C. for 45 hours while the flask is stirred to prepare a polyester resin. The polyester resin obtained from the esterification process is partly taken from the flask, and its properties are examined. A weight average molecular weight of the obtained polyester resin is 4050.

(Urethane Extension Process)

The internal pressure of the flask is recovered back to a normal pressure, and 9.06 g of diphenylmethane diisocyanate (MDI (abbreviation), Wako Pure Chemical Industries, Ltd.) and 28.96 g of toluene (Wako Pure Chemical Industries, Ltd.) are added thereto. After introducing nitrogen into the flask, the polyester resin obtained from the esterification process is reacted with diphenylmethane diisocyanate at 97° C. until the diphenylmethane diisocyanate is all reacted but not left with stirring to obtain a urethane-extended polyester resin.

The disappearance of the diphenylmethane diisocyanate is confirmed by taking a part of the solution from the flask and measuring it with an infrared spectrophotometer to find no peak from isocyanate around 2275 $cm^{-1}$.

(Recovery Process)

An amorphous polyester-based resin is obtained by evaporating toluene from the solution in which the urethane-extended polyester resin is formed from the urethane extension process.

A weight average molecular weight of the amorphous polyester-based resin is 12870, and its glass transition temperature is 60.1° C.

Hereinafter, the amorphous polyester-based resin latex according to Preparation Example 2 used in Examples and Comparative Examples is described.

Preparation Example 2

300 g of the amorphous polyester-based resin according to Preparation Example 1, 250 g of methyl ethyl ketone (MEK), and 50 g of isopropyl alcohol (IPA) are put into a 3 L double jacket reaction vessel. Subsequently, the amorphous polyester-based resin of Preparation Example 1 is dissolved in the mixed solvent of the methyl ethyl ketone and the isopropyl alcohol at about 30° C. with stirring with a semicircular impeller. Subsequently, 27 g of a 5% ammonia aqueous solution is slowly added thereto, while the reaction vessel is internally stirred, and 1200 g of water is added thereto at a rate of 20 g/min the mixture with continuous stirring to prepare an emulsion liquid. Then, the mixed solvent of methyl ethyl ketone and isopropyl alcohol is removed from the emulsion through distillation under a reduced pressure until it has a concentration of 26.6 wt % of the amorphous polyester-based resin, thereby obtaining the amorphous polyester-based resin latex. Particles in the amorphous polyester-based resin latex have a volume average particle diameter Dv50 of 109 nm and a volume average particle size distribution index GSDv of 1.17.

Hereinafter, a crystalline polyester resin of Preparation Example 3 used in Examples and Comparative Examples is described.

Preparation Example 3

198.8 g of 1,9-nonanediol (Wako Pure Chemical Industries, Ltd.), 250.8 g of dodecanedioic acid (Wako Pure Chemical Industries, Ltd.), and 0.45 g of paratoluenesulfonic acid 1 hydrate (PTSA (abbreviation), Wako Pure Chemical Industries, Ltd.) are put into a 500 ml separable flask. Subsequently, nitrogen is introduced into the flask, the mixture of the 1,9-nonanediol, the dodecanedioic acid, and the paratoluenesulfonic acid 1 hydrate is heated at 80° C. for dissolution with stirring. The mixed solution in the flask is heated up to 97° C. with continuous stirring. Subsequently, the pressure in the flask is reduced to substantially a vacuum (less than or equal to 10 mPa·s), and a dehydration condensation reaction of the 1,9-nonanediol and the dodecanedioic acid is performed at 97° C. for 5 hours while the flask is internally stirred to obtain a crystalline polyester resin. A weight average molecular weight of the obtained crystalline polyester resin is 13302, and its melting point is 66.99° C.

Hereinafter, a crystalline polyester resin latex of Preparation Example 4 used in Examples and Comparative Examples is described.

Preparation Example 4

300 g of the crystalline polyester resin of Preparation Example 3, 250 g of methyl ethyl ketone (MEK), and 50 g of isopropyl alcohol (IPA) are put into a 3 L double jacket reaction vessel. The crystalline polyester resin of Preparation Example 3 is dissolved in the mixed solvent of the methyl ethyl ketone and the isopropyl alcohol with stirring at about 30° C. with a semicircular impeller. Subsequently, 25 g of a 5% ammonia aqueous solution is slowly added thereto with continuous stirring, and 1200 g of water is added thereto at a rate of 20 g/min to form an emulsion liquid. The mixed solvent of the methyl ethyl ketone and the isopropyl alcohol is removed from the emulsion through distillation under a reduced pressure until it has a concentration of 24.21 wt % of the crystalline polyester resin, thereby obtaining a crystalline polyester resin latex. Particles in the crystalline polyester resin latex have a volume average particle diameter Dv50 of 138 nm and a volume average particle size distribution index GSDv of 1.20.

Hereinafter, the amorphous styrene acryl-based resin latex of Preparation Example 5 used in Example 7 is described.

Preparation Example 5

280 g of styrene (Wako Pure Chemical Industries, Ltd.), 120 g of n-butyl acrylate (Wako Pure Chemical Industries, Ltd.), and 18 g of β-carboxylethyl acrylate (Rhodia Nicca, Ltd.) are put into a 500 ml separable flask. The mixture of the styrene, the n-butyl acrylate, and the β-carboxylethyl acrylate is dissolved therein with stirring. Subsequently, a solution obtained by dissolving 1.5 g of an anionic surfactant (DOWFAX 2A1, Dow Chemical Co.) in 550 g of ion exchange water is added to the flask and dispersed therein by a homogenizer (ULTRA-TURRAX T50, IKA) to form an emulsion liquid. Then, another solution obtained by dissolving 2.3 g of ammonium persulfate (Wako Pure Chemical Industries, Ltd.) in 50 g of ion exchange water is added thereto, while the flask is slowly stirred for 10 minutes. After substituting nitrogen inside the flask, the mixed solution is heated at 65° C. using an oil bath, while the inside of the flask is stirred. Subsequently, an emulsion polymerization of the styrene, the n-butyl acrylate, and the β-carboxylethyl acrylate is performed while the mixed solution in the flask is stirred at 65° C. for 5 hours to form an amorphous styrene acryl-based resin and obtain an amorphous styrene acryl-based resin latex.

A weight average molecular weight of the amorphous styrene acryl-based resin is 451000, and its glass transition temperature is 52.2° C. In addition, particles in the obtained amorphous styrene acryl-based resin latex have a volume average particle diameter Dv50 of 169 nm and a volume average particle size distribution index GSDv of 1.27. The amorphous styrene acryl-based resin in the amorphous styrene acryl-based resin latex has a concentration of 41.0 wt %.

Hereinafter, phosphors of Preparation Examples 6 to 14 used in Examples and Comparative Examples are described.

Preparation Example 6

(Preparation Process of Precursor)

[Formation Process of Suspension]

Amorphous silicon nitride particles having a volume average particle diameter Dv50 of 50 nm (Sigma-Aldrich Co. Ltd.), strontium nitrate (Kishida Chemical Co., Ltd.), europium nitrate hexahydrate (Kishida Chemical Co., Ltd.) are used as a raw material. In order to obtain an oxynitride represented by a composition formula $Eu_{0.1}Sr_{0.9}Si_2O_2N_2$, silicon nitride particles, strontium nitrate, and europium nitrate hexahydrate are respectively weighed in an amount of 28.461 mass %, 57.964 mass %, and 13.575 mass %. The weighed raw materials are added to a mixed solvent of 100 g of water and 50 g of ethylene glycol, and the mixture is stirred to prepare a suspension.

[Formation Process of Precursor]

Ammonium hydrogen carbonate (Kishida Chemical Co., Ltd.) is dissolved in water to prepare 216 ml of an ammonium hydrogen carbonate aqueous solution having a concentration of 0.158 mol/L as a co-precipitator. Then, the co-precipitator is added to the suspension in a dropwise fashion for one hour while the suspension is stirred. After adding the co-precipitator in a dropwise fashion, the mixture keeps being mixed for 2 hours with stirring. In this way, strontium ions and europium ions are respectively precipitated into carbonate salt and hydroxide, the carbonate salt of strontium and the hydroxide of europium are uniformly mixed and deposited on the surface of the silicon nitride particles to form phosphor precursor particles. Subsequently, the suspension including the phosphor precursor particles is subjected to solvent substitution from a mixed solvent of water and ethylene glycol to water via centrifugation. After the solvent substitution, the suspension is placed in a drier set at a temperature of 100° C. to evaporate the water and collect the phosphor precursor particles.

(Firing Process)

The phosphor precursor particles are fired in the following order. First, the phosphor precursor particles are charged in a boron nitride crucible. Subsequently, the crucible charged with the phosphor precursor particles is put in a metal furnace under a vacuum atmosphere (N.E.M.S. Korea Co.). After putting the crucible in the furnace, the pressure in the furnace is reduced to substantially a vacuum with a diffusion pump. Subsequently, a temperature of the inside of the furnace is increased from room temperature up to 1100° C. at a rate of 300° C./hr. Then, a gas mixture of 4 volume % of hydrogen and 96 volume % of nitrogen is injected into the furnace to restore the pressure in the furnace to substantially an atmospheric pressure, while the temperature in the furnace is maintained at 1100° C. Subsequently, the temperature in the furnace is increased up to 1450° C. at a rate of 300° C. and maintained at 1450° C. for 3 hours to fire the phosphor precursor particles and obtain a fired product.

(Characteristics of Phosphor)

The obtained fired product has a light emitting peak wavelength of 550 nm and emits yellowish green light, referring to its fluorescent spectrum. In addition, a powder X-ray diffraction of the fired product shows that an oxynitride having a same crystal structure as $SrSi_2O_2N_2$ is produced therein. Furthermore, a metal element analysis result of the fired product shows that the fired product includes Sr and Eu in a mole ratio of Sr:Eu=0.9:0.1. In addition, a particle size distribution result of the fired product shows that the fired product has a volume average particle diameter Dv50 of 165 nm. Furthermore, the fired product has an internal quantum efficiency of 73% at an excitation wavelength of 450 nm.

Based on the results, the phosphor 1 of Preparation Example 6 includes the oxynitride containing Sr, Eu, and Si. In addition, the phosphor is represented by a composition formula $Eu_{0.1}Sr_{0.9}Si_2O_2N_2$. Referring to the composition formula, the phosphor includes 90 mol % of Sr and 10 mol % of Eu based on a sum of Sr and Eu. In addition, the oxynitride has a same crystal structure as $SrSi_2O_2N_2$. Furthermore, the phosphor has a volume average particle diameter Dv50 of 165 nm. In addition, the phosphor has an internal quantum efficiency of 73% at an excitation wavelength of 450 nm.

Preparation Example 7

Phosphor precursor particles and a fired product are obtained in the same manner as Preparation Example 6 except for respectively weighing silicon nitride particles, strontium nitrate, and europium nitrate 6 hydrate in an amount of 27.481 mass %, 52.858 mass %, and 19.661 mass % in order to obtain an oxynitride represented by $Eu_{0.15}Sr_{0.85}Si_2O_2N_2$.

The fired product has a light emitting peak wavelength of 551 nm and emits yellowish green light. In addition, in the fired product, an oxynitride having a same crystal structure as $SrSi_2O_2N_2$ is produced. In addition, the fired product includes Sr and Eu in a mole ratio of Sr:Eu=0.85:0.15. Furthermore, the fired product has a volume average particle diameter Dv50 of 168 nm. In addition, the fired product has an internal quantum efficiency of 75% at an excitation wavelength of 450 nm.

Based on the results, a phosphor 2 according to Preparation Example 7 includes an oxynitride containing Sr, Eu, and Si. In addition, the phosphor is represented by a composition formula $Eu_{0.15}Sr_{0.85}Si_2O_2N_2$. Referring to the composition formula, the phosphor includes 85 mol % of Sr and 15 mol % of Eu based on a sum of Sr and Eu. The oxynitride has a same crystal structure as $SrSi_2O_2N_2$. In addition, the phosphor has a volume average particle diameter Dv50 of 168 nm. In addition, the phosphor has an internal quantum efficiency of 75% at an excitation wavelength of 450 nm.

Preparation Example 8

Amorphous silicon nitride particles having a volume average particle diameter Dv50 of 50 nm (Sigma-Aldrich Co. Ltd.), strontium nitrate (Kishida Chemical Co., Ltd.), calcium nitrate 4 hydrate (Kishida Chemical Co., Ltd.), and europium nitrate 6 hydrate (Kishida Chemical Co., Ltd.) are used a raw material. In order to obtain an oxynitride represented by $Eu_{0.1}Sr_{0.45}Ca_{0.45}Si_2O_2N_2$, the silicon nitride particles, the strontium nitrate, the calcium nitrate 4 hydrate, and the europium nitrate 6 hydrate are weighed in an amount of 27.537 mass %, 28.040 mass %, 31.289 mass %, and 13.134 mass %, respectively. Phosphor precursor particles and a fired product are obtained in the same manner as Preparation Example 6 except for the above.

The fired product has a light emitting peak wavelength of 543 nm and emits yellowish green light. In addition, in the fired product, an oxynitride having a same crystal structure as $SrSi_2O_2N_2$ is produced. In addition, the fired product includes Sr, Ca, and Eu in a mole ratio of Sr:Ca:Eu=0.45:0.45:0.1. Furthermore, the fired product has a volume average particle diameter Dv50 of 142 nm. In addition, the fired product has an internal quantum efficiency of 81% at an excitation wavelength of 450 nm.

Based on the results, a phosphor 3 according to Preparation Example 8 includes the oxynitride containing Sr, Ca, Eu, and Si. In addition, the phosphor is represented by a composition formula $Eu_{0.1}Sr_{0.45}Ca_{0.45}Si_2O_2N_2$. Referring to the composition formula, the phosphor includes 45 mol % of Sr and 10 mol % of Eu based on a sum of Sr, Ca, and Eu. In addition, the oxynitride has a same crystal structure as $SrSi_2O_2N_2$. In addition, the phosphor has a volume average particle diameter Dv50 of 142 nm. Furthermore, the phosphor has an internal quantum efficiency of 81% at an excitation wavelength of 450 nm.

Preparation Example 9

Amorphous silicon nitride particles having a volume average particle diameter Dv50 of 50 nm (Sigma-Aldrich Co. Ltd.), strontium nitrate (Kishida Chemical Co., Ltd.), barium nitrate (Kishida Chemical Co., Ltd.), and europium nitrate 6 hydrate (Kishida Chemical Co., Ltd.) are used as a raw material.

In order to obtain an oxynitride represented by $Eu_{0.1}Sr_{0.8}Ba_{0.1}Si_2O_2N_2$, silicon nitride particles, the strontium nitrate, the barium nitrate, and the europium nitrate 6 hydrate are weighed in an amount of 28.0 mass %, 50.8 mass %, 7.8 mass %, and 13.4 mass %, respectively. Except for the above, phosphor precursor particles and a fired product are obtained in the same manner as Preparation Example 6. The fired product has a light emitting peak wavelength of 548 nm and emits yellowish green light. In addition, in the fired product, an oxynitride having a same crystal structure as $SrSi_2O_2N_2$ is produced. In addition, the fired product includes Sr, Ba, and Eu in a mole ratio of Sr:Ba:Eu=0.8:0.1:0.1. Furthermore, the fired product has a volume average particle diameter Dv50 of 335 nm. In addition, the fired produce has an internal quantum efficiency of 75% at an excitation wavelength of 450 nm.

Based on the results, a phosphor 4 of Preparation Example 9 includes the oxynitride containing Sr, Ba, Eu, and Si. In addition, the phosphor is represented by $Eu_{0.1}Sr_{0.8}Ba_{0.1}Si_2O_2N_2$. Referring to the composition formula, the phosphor includes 80 mol % of Sr and 10 mol % of Eu based on a sum of Sr, Ba, and Eu. In addition, the oxynitride has a same crystal structure as $SrSi_2O_2N_2$. In addition, the phosphor has a volume average particle diameter Dv50 of 335 nm. Furthermore, the phosphor has an internal quantum efficiency of 75% at an excitation wavelength of 450 nm.

Preparation Example 10

Phosphor precursor particles are obtained in the same manner as Preparation Example 6. In addition, a fired product is obtained in the same manner as Preparation Example 6 except for firing the phosphor precursor particles at 1700° C.

The fired product has a light emitting peak wavelength of 551 nm and emits yellowish green light. In addition, in the fired product, an oxynitride having a same crystal structure as $SrSi_2O_2N_2$ is produced. Furthermore, the fired product includes Sr and Eu in a mole ratio of Sr:Eu=0.9:0.1. In addition, the fired product has a volume average particle diameter D50V of 960 nm. In addition, the fired product has an internal quantum efficiency of 81% at an excitation wavelength of 450 nm.

Based on the results, a phosphor 5 of Preparation Example 10 includes the oxynitride containing Sr, Eu, and Si. In addition, the phosphor is represented by $Eu_{0.1}Sr_{0.9}Si_2O_2N_2$. Referring to the composition formula, the phosphor includes 90 mol % of Sr and 10 mol % of Eu based on a sum of Sr and Eu. In addition, the oxynitride has a same crystal structure as $SrSi_2O_2N_2$. Furthermore, the phosphor has a volume average particle diameter Dv50 of 960 nm. In addition, the phosphor has an internal quantum efficiency of 81% at an excitation wavelength of 450 nm.

Preparation Example 11

Phosphor precursor particles and a fired product are obtained in the same manner as Preparation Example 6 except for respectively weighing silicon nitride particles, strontium nitrate, and europium nitrate 6 hydrate in an amount of 30.530 mass %, 68.741 mass %, and 0.728 mass % in order to obtain an oxynitride represented by $Eu_{0.005}Sr_{0.995}Si_2O_2N_2$.

The fired product has a light emitting peak wavelength of 548 nm and emits yellowish green light. In addition, in the fired product, an oxynitride having a same crystal structure as $SrSi_2O_2N_2$ is produced. Furthermore, the fired product includes Sr and Eu in a mole ratio of Sr:Eu=0.995:0.005. In addition, the fired product has a volume average particle diameter Dv50 of 123 nm. In addition, the fired product has an internal quantum efficiency of 52% at an excitation wavelength of 450 nm.

Based on the results, a phosphor 6 of Preparation Example 11 includes an oxynitride containing Sr, Eu, and Si. In addition, the phosphor is represented by $Eu_{0.005}Sr_{0.995}Si_2O_2N_2$. Referring to the composition formula, the phosphor includes 99.5 mol % of Sr and 0.5 mol % of Eu based on a sum of Sr and Eu. In addition, the oxynitride has a same crystal structure as $SrSi_2O_2N_2$. Furthermore, the phosphor has a volume average particle diameter Dv50 of 123 nm. In addition, the phosphor has an internal quantum efficiency of 52% at an excitation wavelength of 450 nm.

Preparation Example 12

Phosphor precursor particles are obtained in the same manner as Preparation Example 8 except for respectively weighing silicon nitride particles, strontium nitrate, calcium nitrate 4 hydrate, and europium nitrate 6 hydrate in each amount of 26.858 mass %, 6.078 mass %, 54.254 mass %, and 12.810 mass % in order to obtain an oxynitride represented by $Eu_{0.1}Sr_{0.1}Ca_{0.8}Si_2O_2N_2$. In addition, the phosphor precursor particles are fired in the same manner as Preparation Example 6.

In Preparation Example 12, a phosphor is not obtained because the phosphor precursor particles melt during the firing. The reason is that a greater amount of calcium is included in the phosphor precursor particles and thus lowers a melting point of the oxynitride synthesized during the firing.

Preparation Example 13

Phosphor precursor particles and a fired product are obtained in the same manner as Preparation Example 6 except for respectively weighing silicon nitride particles, strontium nitrate, and europium nitrate 6 hydrate in an amount of 25.710 mass %, 43.634 mass %, and 30.657 mass % in order to obtain an oxynitride represented by $Eu_{0.25}Sr_{0.75}Si_2O_2N_2$. The fired product has a light emitting peak wavelength of 545 nm and emits yellowish green light. In addition, in the fired product, an oxynitride having a same crystal structure as $SrSi_2O_2N_2$ is produced. Furthermore, the fired product includes Sr and Eu in a mole ratio of Sr:Eu=0.75:0.25. In addition, the fired product has a volume average particle diameter Dv50 of 172 nm. In addition, the fired product has an internal quantum efficiency of 48% at an excitation wavelength of 450 nm.

Based on the results, a phosphor 8 of Preparation Example 13 includes the oxynitride containing Sr, Eu, and Si. In addition, the phosphor is represented by $Eu_{0.25}Sr_{0.75}Si_2O_2N_2$. Referring to the composition formula, the phosphor includes 75 mol % of Sr and 25 mol % of Eu based on a sum of Sr and Eu. In addition, the oxynitride has a same crystal structure as $SrSi_2O_2N_2$. Furthermore, the phosphor has a volume average particle diameter Dv50 of 172 nm. In addition, the phosphor has an internal quantum efficiency of 48% at an excitation wavelength of 450 nm.

The following Table 1 shows properties of the phosphors 1 to 8 obtained from Preparation Examples 6 to 13. A phosphor is not obtained in Preparation Example 12, but the result of Preparation Example 12 is listed as a phosphor 7 in Table 1.

TABLE 1

| | Composition formula | Light emitting peak | Internal quantum efficiency | Phosphor Dv50 (nm) |
|---|---|---|---|---|
| phosphor 1 | $Eu_{0.1}Sr_{0.9}Si_2O_2N_2$ | 550 nm | 73% | 165 nm |
| phosphor 2 | $Eu_{0.15}Sr_{0.85}Si_2O_2N_2$ | 551 nm | 75% | 168 nm |
| phosphor 3 | $Eu_{0.1}Sr_{0.45}Ca_{0.45}Si_2O_2N_2$ | 543 nm | 81% | 142 nm |
| phosphor 4 | $Eu_{0.1}Sr_{0.8}Ba_{0.1}Si_2O_2N_2$ | 548 nm | 75% | 335 nm |
| phosphor 5 | $Eu_{0.1}Sr_{0.9}Si_2O_2N_2$ | 551 nm | 81% | 960 nm |
| phosphor 6 | $Eu_{0.005}Sr_{0.995}Si_2O_2N_2$ | 548 nm | 52% | 123 nm |
| phosphor 7 | $Eu_{0.1}Sr_{0.1}Ca_{0.8}Si_2O_2N_2$ | none | none | none |
| phosphor 8 | $Eu_{0.25}Sr_{0.75}Si_2O_2N_2$ | 545 nm | 48% | 172 nm |

Hereinafter, phosphor dispersions of Preparation Example 14 to 20 used in Examples and Comparative Examples are described.

Preparation Example 14

13.0 g of the phosphor prepared in Preparation Example 6, 0.3 g of an anionic surfactant (DOWFAX 2A1, Dow Chemical Co.), and 28.2 g of ion exchange water are put into a 100 ml reaction vessel, and 40 ml of a zirconia ($ZrO_2$) bead having a diameter of 0.5 mm is put therein. Subsequently, the mixture is bead-milled to obtain phosphor dispersion. Particles in the phosphor dispersion have a volume average particle diameter Dv50 of 165 nm. In addition, the phosphor 1 in the phosphor dispersion has a concentration of 6.10 wt %.

Preparation Examples 15 to 20

Phosphor dispersions of Preparation Examples 15 to 20 are obtained in the same manner as Preparation Example 14 using the phosphors 2, 6, and 8 of Preparation Examples 7, 11, and 13, respectively. Hereinafter, non-fluorescent colorant dispersions according to Preparation Examples 21 and 22 used in Examples and Comparative Examples are described.

Preparation Example 21

60 g of a yellow pigment (PY74 (C.I. (color index) number)) and 10 g of an anionic reactive interface surfactant (HS-10, Daiichi Pharmaceutical Industry) are put into a milling bath, and 400 g of glass beads having a diameter of greater than or equal to 0.8 mm and less than or equal to 1 mm are further added thereto. Next, the mixture is milled in the milling bath at room temperature to obtain a non-fluorescent colorant dispersion. The obtained non-fluorescent colorant dispersion includes a non-fluorescent colorant in a concentration of 17.34 wt %.

Preparation Example 22

A non-fluorescent colorant dispersion of Preparation Example 22 is obtained in the same manner as Preparation Example 21 except for using a yellow pigment (PY185 (C.I. number)) instead of the yellow pigment (PY74 (C.I. number)).

Hereinafter, a release agent dispersion including a release agent according to Preparation Example 23 used in Examples and Comparative Examples is described.

Preparation Example 23

270 g of paraffin wax (HNP-9, Nippon Seiro Co., Ltd.), 2.7 g of an anionic surfactant (DOWFAX 2A1, Dow Chemical Co.), and 400 g of ion exchange water are put into a reaction vessel. Subsequently, the mixture in the reaction vessel is heated at 110° C., dispersed with a homogenizer (ULTRA-TURRAX T50, IKA company) and also, with a high pressure homogenizer (NanoVater NVL-ES008, Yoshida Machinery Co., Ltd.) for 360 minutes to obtain a release agent dispersion. A concentration of a release agent in the obtained release agent dispersion is 29.3 wt %.

Hereinafter, a method of producing a toner for developing electrostatic images according to Examples and Comparative Examples is described.

Example 1

623.4 g of the amorphous polyester-based resin latex of Preparation Example 2, 51.6 g of the crystalline polyester resin latex of Preparation Example 4, 60.1 g of the phosphor dispersion of Preparation Example 14, 70.7 g of the non-fluorescent colorant dispersion of Preparation Example 21, 89.0 g of the release agent dispersion of Preparation Example 23, 7.0 g of an anionic surfactant (DOWFAX 2A1, Dow Chemical Co.), and 836.2 g of deionized water are put into a 3 L reaction vessel. Subsequently, the mixture in the reaction vessel is stirred with a homogenizer (ULTRA-TURRAX T50, IKA Company) for 3 minutes. Subsequently, 76.1 g of PSI-100 (a polysilicate-iron concentration of 3.0 wt %, Suido Kiko Kaisha, Ltd.) as an agglomerating agent is added thereto. Then, the mixture in the reaction vessel is heated up to 44° C. at a rate of 1° C./min and up to 47° C.

at a rate of 0.03° C./min and maintained at 47° C. with stirring with a homogenizer until primary agglomeration particles having a volume average particle diameter ranging from greater than or equal to 5 μm and less than or equal to 6 μm are obtained. Herein, the stirring is performed by controlling spinning times of a spin wing of the homogenizer depending on a viscosity change of the mixed solution in the reaction vessel. The primary agglomeration particles are examined to have a predetermined volume average particle diameter by taking a part of the mixed solution from the reaction vessel. Subsequently, 260.2 g of the amorphous polyester-based resin latex of Preparation Example 2 is added thereto, the mixture in the reaction vessel is stirred to agglomerate the primary agglomeration particles with the amorphous polyester-based resin for 60 minute, form the amorphous polyester-based resin into a coating layer on the surface of the primary agglomeration particles, and resultantly obtain a coated agglomeration particle dispersion. Subsequently, 57.9 g of a sodium hydroxide aqueous solution having a concentration of 1 N is added thereto, and the mixture in the reaction vessel is maintained for 20 minutes with stirring. Then, the mixed solution in the reaction vessel is heated up to 89° C. and maintained at the same temperature with stirring until the coated agglomeration particles have circularity of greater than or equal to 0.97 and less than or equal to 0.98. Subsequently, the mixed solution in the reaction vessel is cooled down to 28° C. and filtered to collect toner particles, and the toner particles are dried to obtain Toner 1 for developing electrostatic images.

Toner 1 for developing electrostatic images has a 0.2 μm to 1.0 μm-thick coating layer.

Example 2

Toner 2 for developing electrostatic images in Example 2 is obtained in the same manner as Example 1 except for using the phosphor 2 instead of the phosphor 1.

Example 3

Toner 3 for developing electrostatic images in Example 3 is obtained in the same manner as Example 1 except for using the phosphor 3 instead of the phosphor 1.

Example 4

Toner 4 for developing electrostatic images in Example 4 is obtained in the same manner as Example 1 except for using the phosphor 4 instead of the phosphor 1.

Example 5

Toner 5 for developing electrostatic images in Example 5 is obtained in the same manner as Example 1 except for changing an addition amount of the colorant (i.e., a sum of a phosphor and a non-fluorescent colorant) and a ratio of the phosphor in the colorant as shown in Table 2 below.

Specifically, 623.4 g of the amorphous polyester-based resin latex of Preparation Example 2, 51.6 g of the crystalline polyester resin latex of Preparation Example 4, 105.6 g of the phosphor dispersion of Preparation Example 14, 78.9 g of the non-fluorescent colorant dispersion of Preparation Example 21, 89.0 g of the release agent dispersion of Preparation Example 23, 7.0 g of an anionic surfactant (DOWFAX 2A1, Dow Chemical Co.), and 782.5 g of deionized water are put into a 3 L reaction vessel in Example 5. Subsequently, 77.2 g of PSI-100 as an agglomerating agent is added thereto. After obtaining primary agglomeration particles, 260.7 g of the amorphous polyester-based resin latex of Preparation Example 2 is added in the reaction vessel.

Example 6

Toner 6 for developing electrostatic images in Example 6 is obtained in the same manner as Example 1 except for changing the addition amount of the colorant (i.e., a sum of a phosphor and a non-fluorescent colorant) as shown in Table 2 below.

Specifically, 623.4 g of the amorphous polyester-based resin latex of Preparation Example 2, 51.6 g of the crystalline polyester resin latex of Preparation Example 4, 48.1 g of the phosphor dispersion of Preparation Example 14, 56.6 g of the non-fluorescent colorant dispersion of Preparation Example 21, 89.0 g of the release agent dispersion of Preparation Example 23, 7.0 g of an anionic surfactant (DOWFAX 2A1, Dow Chemical Co.), and 862.4 g of deionized water are put into a 3 L reaction vessel in Example 6. Subsequently, 77.2 g of PSI-100 as an agglomerating agent is added thereto. After obtaining primary agglomeration particles, 260.7 g of the amorphous polyester-based resin latex of Preparation Example 2 is added to the reaction vessel.

Example 7

Toner 7 for developing electrostatic images is prepared in the same manner as Example 1 except for using an amorphous styrene acryl-based resin instead of the amorphous polyester-based resin and the crystalline polyester resin as a binder in Example 7.

Specifically, 434.9 g of the amorphous styrene acryl-based resin latex of Preparation Example 5, 60.1 g of the phosphor dispersion of Preparation Example 14, 70.7 g of the non-fluorescent colorant dispersion of Preparation Example 21, 89.0 g of the release agent dispersion of Preparation Example 23, 7.0 g of an anionic surfactant (DOWFAX 2A1, Dow Chemical Co.), and 1167.9 g of deionized water are put into a 3 L reaction vessel in Example 7. Subsequently, 77.2 g of PSI-100 as an agglomerating agent is added thereto. After obtaining primary agglomeration particles, 169.1 g of the amorphous styrene acryl-based resin of Preparation Example 5 is added thereto.

Example 8

Toner 8 for developing electrostatic images is obtained in the same manner as Example 1 except for using PY185 instead of the PY74 as the non-fluorescent colorant in Example 8.

Example 9

Toner 9 for developing electrostatic images is obtained in the same manner as Example 1 except for changing the addition amount of the agglomerating agent as shown in Table 2 below in Example 9. Specifically, 90.3 g of PSI-100 as the agglomerating agent is added thereto.

Example 10

Toner 10 for developing electrostatic images is obtained in the same manner as Example 1 except for changing the addition amount of the agglomerating agent as shown in Table 2 below in Example 10. Specifically, 61.8 g of PSI-100 as the agglomerating agent is added thereto.

The following Table 2 shows conditions for producing the toners 1 to 10 for developing electrostatic images according to Examples 1 to 10 and their properties.

TABLE 2

| | Example | | | | | | | | | |
|---|---|---|---|---|---|---|---|---|---|---|
| | 1 | 2 | 3 | 4 | 5 | 6 | 7 | 8 | 9 | 10 |
| Toner No. | 1 | 2 | 3 | 4 | 5 | 6 | 7 | 8 | 9 | 10 |
| PSI amount (wt %) | 0.80 | 0.80 | 0.80 | 0.80 | 0.80 | 0.80 | 0.80 | 0.80 | 0.95 | 0.60 |
| Colorant addition amount (wt %) | 5.50 | 5.50 | 5.50 | 5.50 | 6.95 | 4.40 | 5.50 | 5.50 | 5.50 | 5.50 |
| Pigment | PY74 | PY74 | PY74 | PY74 | PY74 | PY74 | PY74 | PY185 | PY74 | PY74 |
| Phosphor | Phosphor 1 | Phosphor 2 | Phosphor 3 | Phosphor 4 | Phosphor 1 | Phosphor 1 | Phosphor 1 | Phosphor 1 | Phosphor 1 | Phosphor1 |
| Ratio of Phosphor in Colorant (wt %) | 23.0 | 23.0 | 23.0 | 23.0 | 32.0 | 23.0 | 23.0 | 23.0 | 23.0 | 23.0 |
| Received phosphor ratio (wt %) | 74.3 | 73.5 | 74.6 | 76.2 | 73.4 | 75.6 | 74.3 | 75.5 | 73.6 | 76.5 |
| Colorant Content (wt %) | 5.2 | 5.2 | 5.2 | 5.2 | 6.4 | 4.2 | 5.2 | 5.2 | 5.2 | 5.2 |
| Phosphor Content (wt %) | 0.94 | 0.93 | 0.94 | 0.96 | 1.63 | 0.77 | 0.94 | 0.96 | 0.93 | 0.97 |
| Type of Resin | PEs | PEs | PEs | PEs | PEs | PEs | Styrene Acryl | PEs | PEs | PEs |
| Toner Tg (° C.) | 50.2 | 50.2 | 50.5 | 50.3 | 50.6 | 50.3 | 50.4 | 50.2 | 50.7 | 50.5 |
| Toner Mw | 14925 | 12568 | 12056 | 14565 | 15656 | 16257 | 42356 | 15369 | 14589 | 14336 |
| Toner Mw/Mn | 13.7 | 14.7 | 15.8 | 11.5 | 13.6 | 12.5 | 15.5 | 8.8 | 12.2 | 13.5 |
| Toner acid value (mg KOH/g) | 18 | 20 | 22 | 18 | 18 | 17 | 8 | 18 | 19 | 18 |
| Toner Dv50 (μm) | 6.86 | 6.52 | 5.95 | 6.21 | 5.85 | 5.89 | 6.35 | 6.30 | 6.92 | 6.33 |
| Toner <3 μm (number %) | 2.58 | 2.98 | 2.88 | 2.75 | 2.84 | 2.79 | 2.58 | 2.48 | 2.51 | 2.66 |
| Coefficient of variation of toner particle diameter CV(%) | 21.1 | 21.4 | 21.2 | 21.5 | 21.3 | 21.6 | 21.5 | 21.4 | 21.6 | 21.5 |
| Toner GSDv | 1.24 | 1.25 | 1.24 | 1.25 | 1.25 | 1.26 | 1.26 | 1.25 | 1.26 | 1.26 |
| Electric Charge quantity (μC/g) | 89.8 | 88.8 | 86.9 | 91.2 | 92.6 | 87.6 | 87.6 | 87.7 | 89.6 | 92.5 |
| MFT(° C.) | 120 | 121 | 120 | 120 | 125 | 118 | 128 | 119 | 125 | 116 |
| L* | 103.05 | 104.51 | 104.25 | 103.27 | 104.86 | 100.08 | 103.53 | 103.36 | 103.30 | 103.50 |
| a* | −3.12 | −3.03 | −3.15 | −2.98 | −3.55 | −3.12 | −3.02 | −1.72 | −3.15 | −3.15 |
| b* | 103.23 | 103.15 | 103.83 | 102.55 | 105.23 | 99.55 | 102.85 | 104.75 | 101.12 | 104.23 |
| Image Concentration | 1.05 | 1.02 | 1.04 | 1.03 | 1.07 | 0.97 | 1.03 | 1.03 | 0.95 | 1.09 |
| Fe (ppm) | 2470 | 2456 | 2520 | 2555 | 2435 | 2462 | 2463 | 2463 | 2853 | 1856 |
| Si (ppm) | 6930 | 6580 | 7258 | 7186 | 11325 | 5230 | 6853 | 6923 | 6995 | 6869 |
| S(ppm) | 1030 | 884 | 865 | 1056 | 1083 | 956 | 973 | 1003 | 1195 | 653 |

In Table 2, the "PSI amount" indicates a ratio of an amount of polysilicate-iron (solid) to an amount sum of an agglomerating agent (solid), a binder (solid), a phosphor (solid), a non-fluorescent colorant (solid), and a release agent (solid) put in a reaction vessel.

The "colorant addition amount" is a ratio of an amount of the non-fluorescent colorant (solid) and the phosphor (solid) to the amount sum of the agglomerating agent (solid), the binder (solid), the phosphor (solid), the non-fluorescent colorant (solid), and the release agent (solid) put in the reaction vessel.

The "pigment" is a type of the non-fluorescent colorant.

The "ratio of phosphor in colorant" indicates a ratio of an amount of the phosphor (solid) to an amount sum of the phosphor (solid) and the non-fluorescent colorant (solid) put in the reaction vessel.

The "received phosphor ratio" indicates a ratio of an amount of the phosphor received into a manufactured toner to the amount of the phosphor (solid) put in the reaction vessel.

The "colorant content" is an amount of the colorant in the manufactured toner.

The "phosphor content" is an amount of the phosphor in the manufactured toner.

The "type of resin" indicates a type of resin used as a binder.

"PEs" indicates polyester.

The "toner Tg" indicates a glass transition temperature of the manufactured toner.

The "toner Mw" indicates a weight average molecular weight of the manufactured toner.

The "toner Mw/Mn" indicates a ratio of the weight average molecular weight of the manufactured toner to its number average molecular weight.

The "toner acid value" indicates an acid value of the manufactured toner.

The "toner Dv50" indicates a volume average particle diameter of the manufactured toner.

The "toner<3 μm" indicates an amount of particles having a particle diameter of less than or equal to 3 μm in the manufactured toner.

The "coefficient of variation of toner particle diameter CV" indicates a coefficient of variation of a particle diameter in the manufactured toner.

The "toner GSDv" indicates a volume average particle size distribution index of the manufactured toner.

The "electric charge quantity" indicates an electric charge quantity of the manufactured toner.

The "MFT" indicates a minimum fusing temperature of the manufactured toner.

"L*", "a*", and "b*" specify a color value of the manufactured toner.

The "image concentration" is an image concentration of the manufactured toner.

"Fe", "Si", and "S" indicate contents of an iron element, a silicon element, and a sulfur element in the manufactured toner.

The "colorant content" and the "phosphor content" are calculated from the following equations:

Colorant content=colorant addition amount×(1−ratio of phosphor in colorant/100×(1−received phosphor ratio/100))

Phosphor content=colorant addition amount×ratio of phosphor in colorant/100×received phosphor ratio/100

Comparative Example 1

Toner 11 for developing electrostatic images is obtained in the same manner as Example 1 except for using no phosphor. Specifically, 623.4 g of the amorphous polyester-based resin latex of Preparation Example 2, 51.6 g of the crystalline polyester resin latex of Preparation Example 4, 91.9 g of the non-fluorescent colorant dispersion of Preparation Example 23, 89.0 g of the release agent dispersion of Preparation Example 25, 7.0 g of an anionic surfactant (DOWFAX 2A1, Dow Chemical Co.), and 875.2 g of deionized water are put into a 3 L reaction vessel in Comparative Example 1. Subsequently, 77.2 g of PSI-100 is added as the agglomerating agent.

After obtaining primary agglomeration particles, 260.7 g of the amorphous polyester-based resin latex of Preparation Example 2 is added thereto.

Comparative Example 2

Toner 12 for developing electrostatic images is obtained in the same manner as Example 1 except for changing the addition amount of the agglomerating agent as shown in Table 3 below in Comparative Example 2.

Specifically, 623.4 g of the amorphous polyester-based resin latex of Preparation Example 2, 51.6 g of the crystalline polyester resin latex of Preparation Example 4, 60.1 g of the phosphor dispersion of Preparation Example 15, 70.7 g of the non-fluorescent colorant dispersion of Preparation Example 23, 89.0 g of the release agent dispersion of Preparation Example 25, 7.0 g of an anionic surfactant (DOWFAX 2A1, Dow Chemical Co.), and 430.7 g of deionized water are put into a 3 L reaction vessel in Comparative Example 2.

Subsequently, 482.8 g of PSI-100 is added thereto as the agglomerating agent.

After obtaining primary agglomeration particles, 260.7 g of the amorphous polyester-based resin latex of Preparation Example 2 is added to the reaction vessel.

Comparative Example 3

Toner 13 for developing electrostatic images is obtained in the same manner as Example 1 except for reducing the amount of the agglomerating agent as shown in Table 3 below in Comparative Example 3.

Specifically, 623.4 g of the amorphous polyester-based resin latex of Preparation Example 2, 51.6 g of the crystalline polyester resin latex of Preparation Example 4, 60.1 g of the phosphor dispersion of Preparation Example 15, 70.7 g of the non-fluorescent colorant dispersion of Preparation Example 23, 89.0 g of the release agent dispersion of Preparation Example 25, 7.0 g of an anionic surfactant (DOWFAX 2A1, Dow Chemical Co.), and 874.8 g of deionized water are put into a 3 L reaction vessel in Comparative Example 3.

Subsequently, 38.6 g of PSI-100 is added as the agglomerating agent.

After obtaining primary agglomeration particles, 260.7 g of the amorphous polyester-based resin latex of Preparation Example 2 is added in the reaction vessel.

Comparative Example 4

Toner 14 for developing electrostatic images is obtained in the same manner as Example 1 except for using the phosphor 5 instead of the phosphor 1 in Comparative Example 4.

Comparative Example 5

Toner 15 for developing electrostatic images is obtained in the same manner as Example 1 except for using the phosphor 6 instead of the phosphor 1 in Comparative Example 5.

Comparative Example 6

Toner 16 for developing electrostatic images is obtained in the same manner as Example 1 except for using the phosphor 8 instead of the phosphor 1 in Comparative Example 6.

The following Table 3 shows conditions for producing the toners 11 to 16 for developing electrostatic images according to Comparative Examples 1 to 6 and their properties.

TABLE 3

| | Comparative Example | | | | | |
|---|---|---|---|---|---|---|
| | 1 | 2 | 3 | 4 | 5 | 6 |
| Toner No. | 11 | 12 | 13 | 14 | 15 | 16 |
| PSI amount (wt %) | 0.80 | 5.00 | 0.40 | 0.80 | 0.80 | 0.80 |
| Colorant addition amount (wt %) | 5.50 | 5.50 | 5.50 | 5.50 | 5.50 | 5.50 |
| Pigment | PY74 | PY74 | PY74 | PY74 | PY74 | PY74 |
| Phosphor | None | Phosphor 1 | Phosphor 1 | Phosphor 5 | Phosphor 6 | Phosphor 8 |
| Ratio of Phosphor in Colorant (wt %) | 0.0 | 23.0 | 23.0 | 23.0 | 23.0 | 23.0 |
| Received phosphor ratio (wt %) | — | 75.3 | 75.8 | 2.3 | 77.2 | 74.3 |
| Colorant Content (wt %) | 5.2 | 5.2 | 5.2 | 4.3 | 5.2 | 5.2 |
| Phosphor Content (wt %) | 0.00 | 0.95 | 0.96 | 0.03 | 0.98 | 0.94 |

TABLE 3-continued

| | Comparative Example | | | | | |
|---|---|---|---|---|---|---|
| | 1 | 2 | 3 | 4 | 5 | 6 |
| Type of Resin | PEs | PEs | PEs | PEs | PEs | PEs |
| Toner Tg (° C.) | 50.4 | 50.2 | 50.5 | 50.7 | 50.6 | 50.6 |
| Toner Mw | 11252 | 16554 | 16554 | 14925 | 16752 | 16878 |
| Toner Mw/Mn | 13.5 | 13.3 | 13.5 | 13.7 | 13.6 | 13.6 |
| Toner acid value (mg KOH/g) | 20 | 17 | 17 | 18 | 18 | 18 |
| Toner Dv50 (μm) | 6.45 | 6.92 | 6.57 | 6.38 | 6.35 | 6.51 |
| Toner <3 μm (number %) | 2.63 | 2.78 | 5.87 | 2.58 | 2.58 | 2.49 |
| Coefficient of variation of toner particle diameter CV(%) | 21.2 | 25.5 | 25.3 | 21.2 | 21.0 | 21.3 |
| Toner GSDv | 1.25 | 1.35 | 1.34 | 1.25 | 1.24 | 1.25 |
| Electric Charge quantity (μC/g) | 90.1 | 91.2 | 91.2 | 89.8 | 91.2 | 90.2 |
| MFT(° C.) | 115 | 141 | 113 | 114 | 120 | 120 |
| L* | 94.36 | 102.53 | 102.20 | 94.85 | 95.87 | 95.53 |
| a | −9.17 | −3.12 | −3.33 | −9.02 | −8.12 | −8.16 |
| b* | 94.22 | 101.58 | 102.10 | 94.53 | 96.23 | 95.85 |
| Image Concentration | 0.95 | 1.02 | 1.03 | 0.95 | 0.93 | 0.93 |
| Fe (ppm) | 2236 | 11253 | 955 | 2470 | 2516 | 2436 |
| Si (ppm) | 1035 | 8523 | 6712 | 6930 | 7253 | 7135 |
| S(ppm) | 1223 | 1523 | 432 | 1030 | 1028 | 1024 |

The terms in Table 3 are the same as those in Table 2.

As shown in Table 2, Toners 1 to 10 for developing electrostatic images according to Examples 1 to 10 show a minimum fusing temperature (MFT) of less than or equal to 130° C. and thus have an excellent fusing property at a low temperature. As shown in Table 3, Toner 12 for developing electrostatic images according to Comparative Example 2 shows a minimum fusing temperature (MFT) of 141° C., that is, greater than 130° C., and thus has an insufficient fusing property at a low temperature. The reason is that Toner 12 for developing electrostatic images according to Comparative Example 2 includes 11252 ppm of an iron element, which is greater than 10000 ppm.

As shown in Table 2, Toners 1 to 10 for developing electrostatic images according to Examples 1 to 10 have an "L*" value of over 100.

As shown in Table 3, Toner 11 for developing electrostatic images according to Comparative Example 1 has an "L*" value of 94.36, which is lower than those of the toners 1 to 10 for developing electrostatic images according to Examples 1 to 10. The reason is that Toner 11 for developing electrostatic images according to Comparative Example 1 includes no phosphor as a part of a colorant. Toner 14 for developing electrostatic images according to Comparative Example 4 includes a phosphor as a part of a colorant but shows no "L*" value increase. The reason is that Phosphor 5 used in Comparative Example 4 has a volume average particle diameter of 960 nm, which is larger than 400 nm and thus is not sufficiently received into Toner 14 for developing electrostatic images.

Toners 15 and 16 for developing electrostatic images according to Comparative Examples 5 and 6 include a phosphor as a part of a colorant but show no "L*" value increase. The reason is that Phosphor 6 used in Comparative Example 5 and the phosphor 8 used in Comparative Example 6 show each internal quantum efficiency of 52% and 48%, which are less than 60% and thus show an insufficient phosphor effect.

Toners 1 to 10 for developing electrostatic images according to Examples 1 to 10 use a phosphor having a small particle diameter and excellent light emitting characteristics as a part of a colorant and thus have a higher "L*" value and accordingly, may have improved brightness and a wider color expression area without largely changing their own colors.

As shown in Table 2, Toners 1 to 10 for developing electrostatic images according to Examples 1 to 10 have "a coefficient of variation of a toner particle diameter CV" of about 21.5 and a "toner GSDv" of about 1.25. On the contrary, as shown in Table 3, Toner 12 for developing electrostatic images according to Comparative Example 2 has a "coefficient of variation of a particle diameter CV" of 25.5 and a "toner GSDv" of 1.35, which are higher than those of Toners 1 to 10 for developing electrostatic images according to Examples 1 to 10. The reason is that Toner 12 for developing electrostatic images according to Comparative Example 2 has an iron element content of 11252 ppm, which is greater than 10000 ppm.

In addition, Toner 13 for developing electrostatic images according to Comparative Example 3 has a "coefficient of variation of a toner particle diameter CV" of 25.3 and a "toner GSDv" of 1.34, which are higher than those of Toners 1 to 10 for developing electrostatic images according to Examples 1 to 10.

The reason is that Toner 13 for developing electrostatic images according to Comparative Example 3 has an iron element content of 955 ppm, which is less than 1000 ppm.

As such, Toner 12 and 13 for developing electrostatic images according to Comparative Examples 2 and 3 show a higher "coefficient of toner particle diameter variation CV" and a higher "toner GSDv" than those of Toners 1 to 10 for developing electrostatic images according to Examples 1 to 10.

Accordingly, Toners 12 and 13 for developing electrostatic images according to Comparative Examples 2 and 3 include more coarse particles and more fine particles than Toners 1 to 10 for developing electrostatic images according to Examples 1 to 10.

Accordingly, Toners 12 and 13 for developing electrostatic images according to Comparative Examples 2 and 3 tend to deteriorate image quality due to the occurrence of white void regions and to be consumed more.

On the other hand, as shown in Tables 2 and 3, Examples 1 to 10 and Comparative Examples 1 to 6 show no large difference in terms of an electric charge quantity. In addition, as shown in Tables 2 and 3, Examples 1 to 10 and Comparative Examples 1 to 6 show no large difference in terms of an image concentration. Furthermore, as shown in Tables 2 and 3, Examples 1 to 10 and Comparative Examples 2 and 3 show a smaller minus value of "a*" compared with other Comparative Examples. This is because in Examples 1 to 10 and Comparative Examples 2 and 3, the inclusion of the phosphor causes a color mismatch. However, such a difference is not enough to cause any problem during their use. On the other hand, in case of Comparative Examples 4 and 6, a phosphor is included but no color difference occurs. This results from the same reason as in that the "L*" value is not increased.

In the aforementioned Examples, an amorphous polyester-based resin for forming primary agglomeration particles is the same as an amorphous polyester-based resin for forming a coating layer. However, even when the amorphous polyester-based resin for forming primary agglomeration particles is different from the amorphous polyester-based resin for forming a coating layer, a toner for developing electrostatic images having substantially the same characteristics as the aforementioned Examples is obtained.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A toner for developing electrostatic images, the toner comprising:

a binder;

a colorant;

iron;

silicon; and sulfur;

wherein an amount of the iron is greater than or equal to $1.0\times10^3$ ppm and less than or equal to $1.0\times10^4$ ppm;

an amount of the silicon is greater than or equal to $1.0\times10^3$ ppm and less than or equal to $5.0\times10^4$ ppm;

an amount of the sulfur is greater than or equal to 500 ppm and less than or equal to 3000 ppm;

an amount of the colorant is greater than or equal to 3.5 wt % and less than or equal to 7 wt % based on a total weight of the toner;

the colorant comprises a phosphor and a non-fluorescent colorant;

an amount of the phosphor is greater than or equal to 0.25 wt % and less than or equal to 4.55 wt % based on the total weight of the toner;

the phosphor comprises either one or both of a nitride and an oxynitride each comprising an alkaline-earth metal, silicon, and an activator element comprising any one or any combination of any two or more of europium (Eu), cerium (Ce), manganese (Mn), praseodymium (Pr), neodymium (Nd), samarium (Sm), terbium (Tb), dysprosium (Dy), holmium (Ho), erbium (Er), thulium (Tm), and ytterbium (Yb);

a volume average particle diameter of the phosphor is greater than or equal to 50 nm and less than or equal to 400 nm; and an internal quantum efficiency of the phosphor at an excitation wavelength of 450 nm is greater than or equal to 60%.

2. The toner of claim 1, wherein the phosphor comprises an oxynitride having a general chemical formula represented by $MSi_2O_2N_2$;

the oxynitride has a crystal structure that is the same as a crystal structure of $SrSi_2O_2N_2$;

the M comprises the alkaline-earth metal and the activator element;

the alkaline-earth metal comprises Sr and optionally either one or both of Ca and Ba;

the activator element comprises Eu and optionally Ce;

the amount of the Sr is greater than or equal to 15 mol % and less than or equal to 99 mol % based on a total amount of the M;

the amount of the activator element is greater than or equal to 1 mol % and less than or equal to 20 mol % based on the total amount of the M; and the phosphor has a light emitting peak wavelength in a range of greater than or equal to 530 nm and less than or equal to 570 nm.

3. The toner of claim 1, wherein the toner has a solid particle, and comprises a coating layer consisting of the binder on its outer surface.

4. The toner of claim 3, wherein the coating layer has a thickness of greater than or equal to 0.2 μm and less than or equal to 1.0 μm.

5. The toner of claim 1, wherein the toner has a volume average particle diameter of greater than or equal to 3 μm and less than or equal to 9 μm.

6. The toner of claim 1, wherein a coefficient of variation of a particle diameter of the toner is greater than or equal to 15% and less than or equal to 25%.

7. The toner of claim 1, wherein the toner has a weight average molecular weight of greater than or equal to 7000 and less than or equal to 50000.

8. The toner of claim 1, wherein a ratio of a weight average molecular weight to a number average molecular weight of the toner is greater than or equal to 7.0 and less than or equal to 17.0.

9. The toner of claim 1, wherein a glass transition temperature of the toner is greater than or equal to 50° C. and less than or equal to 70° C.

10. The toner of claim 1, wherein an acid value of the toner is greater than or equal to 5 mg KOH/g and less than or equal to 25 mg KOH/g.

11. The toner of claim 1, wherein the binder comprises an amorphous polyester-based resin and a crystalline polyester resin.

12. The toner of claim 1, wherein the binder comprises any one or any combination of any two or more of an amorphous styrene polymer, an amorphous acrylic polymer, and an amorphous styrene-acryl copolymer.

13. The toner of claim 1, wherein the non-fluorescent colorant comprises either one or both of a dye and a pigment.

14. A method of producing a toner for developing electrostatic images of claim 1, the method comprising:

forming a latex of a binder;

forming a first dispersion of the phosphor;

forming a second dispersion of the non-fluorescent colorant;

mixing the latex, the first dispersion, and the second dispersion to form a mixed solution; and adding an agglomerating agent to the mixed solution to form a primary agglomeration particle comprising the binder, the phosphor, and the non-fluorescent colorant.

15. The method of claim 14, further comprising disposing a coating layer consisting of the binder on the surface of the primary agglomeration particle to form a coated agglomeration particle.

16. The method of claim 15, wherein the binder comprises an amorphous binder; and the method further comprises heating a dispersion comprising the coated agglomeration particle at a higher temperature than a glass transition temperature of the amorphous binder to fuse particles in the coated agglomeration particle.

17. The method of claim 14, wherein the first dispersion and the second dispersion each comprise an anionic surfactant.

18. The method of claim 14, wherein the agglomerating agent comprises the iron and the silicon.

19. The method of claim 14, wherein a volume average particle diameter of the primary agglomeration particle is greater than or equal to 2.5 μm and less than or equal to 8.5 μm.

20. A toner for developing electrostatic images, the toner comprising:

a binder;

a colorant;

iron;

silicon; and sulfur;

wherein the colorant comprises a phosphor and a non-fluorescent colorant;

the phosphor comprises either one or both of a nitride and an oxynitride each comprising an alkaline-earth metal, silicon, and an activator element comprising any one or any combination of any two or more of europium (Eu), cerium (Ce), manganese (Mn), praseodymium (Pr), neodymium (Nd), samarium (Sm), terbium (Tb), dysprosium (Dy), holmium (Ho), erbium (Er), thulium (Tm), and ytterbium (Yb);

a volume average particle diameter of the phosphor is greater than or equal to 50 nm and less than or equal to 400 nm; and an internal quantum efficiency of the phosphor at an excitation wavelength of 450 nm is greater than or equal to 60%.

21. The toner of claim 20, wherein an amount of the iron is greater than or equal to $1.0\times10^3$ ppm and less than or equal to $1.0\times10^4$ ppm;

an amount of the silicon is greater than or equal to $1.0\times10^3$ ppm and less than or equal to $5.0\times10^4$ ppm; and an amount of the sulfur is greater than or equal to 500 ppm and less than or equal to 3000 ppm.

22. The toner of claim 20, wherein an amount of the colorant comprising the phosphor and the non-fluorescent colorant is greater than or equal to 3.5 wt % and less than or equal to 7 wt % based on a total weight of the toner; and an amount of the phosphor is greater than or equal to 0.25 wt % and less than or equal to 4.55 wt % based on the total weight of the toner.

* * * * *